US007241062B2

(12) United States Patent
Takada et al.

(10) Patent No.: US 7,241,062 B2
(45) Date of Patent: Jul. 10, 2007

(54) METHOD OF CONTROLLING TAPE PROCESSING APPARATUS, APPARATUS FOR PROCESSING TAPE, AND PROGRAM

(75) Inventors: Makoto Takada, Shiojiri (JP); Shoji Takayama, Azumino (JP); Takayuki Uehara, Koshigaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/351,271

(22) Filed: Feb. 9, 2006

(65) Prior Publication Data

US 2006/0193669 A1 Aug. 31, 2006

(30) Foreign Application Priority Data

Feb. 25, 2005 (JP) ..... 2005-050080

(51) Int. Cl.
*B41J 3/32* (2006.01)

(52) U.S. Cl. ..... 400/109.1; 400/127

(58) Field of Classification Search ..... None
See application file for complete search history.

(56) References Cited

U.S. PATENT DOCUMENTS 3,360,093 A * 12/1967 McDonald et al. ..... 194/223
5,345,230 A * 9/1994 Jackson et al. ..... 340/3.51

FOREIGN PATENT DOCUMENTS

JP 04138417 A * 5/1992
JP 06008530 A * 1/1994
JP 2001088358 A * 4/2001
JP 2003-182158 7/2003

OTHER PUBLICATIONS

HP LaserJet8150, 8150 N, 8150 DN, 8150 HN, and 8150 MFP Printers User Guide□□Copyright 2001 Hewlett-Packard Company□□p. 54.*

* cited by examiner

*Primary Examiner*—Matthew Luu
*Assistant Examiner*—Justin Seo
(74) *Attorney, Agent, or Firm*—Hogan & Hartson LLP

(57) ABSTRACT

A method controls a tape processing apparatus which performs, on a tape to be sent from a tape inlet to a tape outlet along a tape travel passage through an embossing section, a series of tape processing operations of incoming-feed operation to feed the tape from the tape inlet to the embossing section, embossing operation in the embossing section, and of outgoing-feed operation to feed the tape from the embossing section to the tape outlet in an order as mentioned above, and which also indicates in an indicator that the apparatus is in the tape processing operations. The method indicates in the indicator a pre-embossing feed indication to indicate the incoming-feed operation and a post-embossing feed indication to indicate the outgoing-feed operation in an indicating mode which is different from an embossing indication to indicate that the apparatus is in the embossing operation.

8 Claims, 15 Drawing Sheets

(Note: Japanese hiragana character "SHI" is represented in Roman characters; Braille character represents hiragana, not Roman characters.)

(Note: Japanese sentence "TE-N-JI-WO-KA-KU" in alphabets in E1 mean "TO EMBOSS BRAILLE CHARACTERS." Braille characters in E2 correspond to Japanese characters, not alphabets. Same applies to Fig. 11A.)

FEED INDICATION: DURING INCOMING-FEED OPERATION, DURING OUTGOING-FEED OPERATION (FREQUENCY: 1Hz)

EMBOSSING INDICATION: DURING EMBOSSING OPERATION (FREQUENCY: 4Hz)

ABNORMALITY INDICATION: DURING ABNORMAL OPERATION (FREQUENCY:2Hz)

METHOD OF CONTROLLING TAPE PROCESSING APPARATUS, APPARATUS FOR PROCESSING TAPE, AND PROGRAM

The entire disclosure of Japanese Patent Application No. 2005-050080, filed February 25, is expressly incorporated by reference herein.

BACKGROUND

1. Technical Field

The present invention relates to a method of controlling a tape processing apparatus which performs tape processing operations inclusive of a feed operation (or a feeding operation) to feed a processing tape (i.e., a tape to be subjected to processing operations) along a tape travel passage, and an embossing operation to perform embossing on the processing tape, and which also performs indication in an indicator to show that the apparatus is in the tape processing operations. The invention also relates to an apparatus for processing a tape (also referred to as a tape processing apparatus) as well as to a program.

2. Related Art

There is known an apparatus for embossing on a tape-shaped embossing medium Braille characters (or raised letters) which embosses Braille characters readable to a visually handicapped person by his or her touch with fingers. JP-A-2003-182158 is an example related art.

In this kind of Braille-character embossing apparatus, while the tape processing operations inclusive of the tape feed operation and the embossing operation are being performed, an indication is made on a display screen or by an indicating lamp (LED, indicator, or the like) to show that the apparatus is in the course of tape processing.

However, with the indication on the display screen of "in the course of tape processing" (or "tape being processed") alone, or simply with the indicating lamp being lighted up (switched on), the user cannot judge whether the apparatus is in the course of tape feed operation or in the course of embossing operation. Especially, when the audibly handicapped user (i.e., the person who cannot hear) uses the apparatus, the user cannot hear the embossing sound (or noise) generated at the time of embossing. Therefore, the user cannot make a judgment based on this embossing sound. There is thus a possibility that the user may manually pull out the tape even when the embossing operation is already or still going on, resulting in a damage to an embossing head. In addition, in case the processed tape has been found to have no embossing thereon, it cannot be judged as to whether the embossing control itself was not performed or whether the problem lies in the embossing mechanism which drives the embossing head. Furthermore, in case this kind of abnormality in embossing has happened, the technical supporting section of the manufacturer cannot see the cause for the problem. Therefore, even if the user tries to get help from the technical supporting section of the manufacturer, technical support will hardly be obtained.

SUMMARY

It is an advantage of the invention to provide a method of controlling a tape processing apparatus in which, during the tape processing operations, the user can visually recognize as to whether the apparatus is in the course of embossing operation, or of tape feed operation. It is also an advantage of the invention to provide an apparatus for processing a tape, as well as a program.

According to a first aspect of the invention, a method of controlling a tape processing apparatus which performs, on a tape to be sent from a tape inlet to a tape outlet along a tape travel passage through an embossing section, a series of tape processing operations of incoming-feed operation to feed the tape from the tape inlet to the embossing section, embossing operation in the embossing section, and of outgoing-feed operation to feed the tape from the embossing section to the tape outlet in an order as mentioned above, and which also indicates in an indicator that the apparatus is in the tape processing operations, comprises indicating in the indicator a pre-embossing feed indication which indicates the incoming-feed operation and a post-embossing feed indication which indicates the outgoing-feed operation in an indicating mode which is different from that of an embossing indication which indicates that the apparatus is in the embossing operation.

According to another aspect of the invention, an apparatus for processing a tape comprises: emboss-processing means for performing, on a tape to be sent from a tape inlet to a tape outlet along a tape travel passage through an embossing section, a series of tape processing operations of incoming-feed operation to feed the tape from the tape inlet to the embossing section, embossing operation in the embossing section, and outgoing-feed operation to feed the tape from the embossing section to the tape outlet in an order mentioned; an indicator to indicate that the apparatus is in the tape processing operations; and indication control means for controlling the indicator such that a pre-embossing feed indication to indicate the incoming-feed operation and a post-embossing feed indication to indicate the outgoing-feed operation are made in an indicating mode which is different from an embossing indication to indicate that the apparatus is in the embossing operation.

In accordance with the embodiments of the invention, the pre-embossing feed indication and the post-embossing feed indication which are the indications during the feed operation are made in the indicator in the indicating mode which is different from the embossing indication which is the indication that the apparatus is in the embossing operation. Therefore, the user can recognize by the indication in the indicator as to whether the apparatus is presently in the embossing operation or not. As a result, there is no possibility that the tape is wrongly pulled out of the apparatus during (or in the midst of) the embossing operation. Further, the user can recognize by the indicator that the incoming-feed operation has started. Therefore, in a construction in which the feeding of the processing tape which is manually inserted into the tape inlet is automatically started, the user can understand the timing of releasing his or her hand off from the processing tape. Still furthermore, in case the embossing has not been successfully performed in the already processed processing tape, the user can judge the cause for the abnormality in embossing depending on whether the embossing indication was made or not. In other words, in case the embossing indication was made, the problem lies in the embossing mechanism and, in case the embossing indication was not made, it means that the embossing control itself was not made. The term "indicator" represents a device such as a display, a touch panel, an indicating lamp, or the like, which reports the information to the user in a visually recognizable state. In addition, the term "to indicate in a different indicating mode" refers to the indication such that the user can visually recognize the difference in indicating contents (inclusive of indication of the text information, display indication), indicating color, indicating time, or the like.

It is preferable that, in the method, the indicator is an indicating lamp and that the embossing indication, the pre-embossing feed indication and the post-embossing feed indication are made by lighting up or flashing of the indicating lamp.

It is also preferable that, in the apparatus, the indicator is an indicating lamp and that the indication control means indicates the embossing indication, the pre-embossing feed indication and the post-embossing feed indication by lighting up or flashing of the indicating lamp.

In accordance with embodiments of the invention, the lighting up or flashing of the indicating lamp indicates that each of the operations is going on. Therefore, the control is easy and the cost for the indicator can be kept low. The "indicating lamp" represents a device which indicates information by lighting up (switching on)/shutting off (switching off) such as light emitting diode (LED), indicator, or the like.

It is preferable that, in the method, the embossing indication, the pre-embossing feed indication, and the post-embossing feed indication are made by flashing of the indicating lamp, and the flashing periods of the pre-embossing feed indication and the post-embossing feed indication are made longer than a flashing period of the embossing indication.

It is preferable that, in the apparatus, the indication control means indicates the embossing indication, the pre-embossing feed indication and the post-embossing feed indication by flashing of the indicating lamp, and that flashing periods of the pre-embossing feed indication and the post-embossing feed indication are longer than the flashing period of the embossing indication.

In accordance with embodiments of the invention, the difference in the flashing periods clearly shows whether the apparatus is in the embossing operation or in the feed operation. Therefore, the user can easily judge which of the operations is being performed.

It is preferable that, in the method, the indicating lamp also indicates an abnormal operation of the apparatus, and that the pre-embossing feed operation and the post-embossing feed operation are made in a mode which is different from that of indicating the abnormal operation.

It is preferable that, in the apparatus, the indication control means indicates an abnormal operation of the apparatus by flashing of the indicating lamp, and that the pre-embossing feed operation and the post-embossing feed operation are indicated in a mode which is different from that of indicating the abnormal operation.

In accordance with embodiments of the invention, the user can judge by the manner of flashing of the indicating lamp (mode of indication) as to whether the apparatus is in abnormal operation or in normal tape processing operations. Therefore, the user can judge in concrete the cause for the trouble in case, e.g., where embossing has not been performed on the processed tape.

It is preferable that, in the method and the apparatus, the pre-embossing operation and the post-embossing operation is made in the same ratio of light-up time and shut-off time in one flashing period, and that the indication of the abnormal operation is made in a different ratio of light-up time and shut-off time in one flashing period.

In accordance with an embodiment of the invention, the indication of the abnormal operation is made in a different ratio of light-up time and shut-off time in one flashing period, resulting in an indication which is quite foreign to an ordinary one. Therefore, it is possible to inform the user, in a more intelligible manner, of the fact that the apparatus is in an abnormal operation.

It is preferable that the emboss-processing means further comprises: tape-feeding means for feeding the processing tape from the tape inlet to the tape outlet through a tape travel passage; and Braille-character embossing means which embosses Braille characters on the processing tape and which is disposed in the embossing section.

In accordance with an embodiment of the invention, it is possible to prepare a Braille-character label in which Braille characters are embossed, in a manner to be recognizable by a visually handicapped person.

It is preferable that the apparatus further comprises printing means for printing ink characters on the processing tape.

In accordance with an embodiment of the invention, it is possible to arrange the Braille characters and the ink characters on the same processing tape to thereby prepare a Braille-character label which can be recognizable by both the visually handicapped person and the person having an ordinary eyesight. The term "ink character", as compared with the term "Braille character", means an ordinary character which can be recognized by a person having an ordinary eyesight without handicap in the eyesight.

In accordance with the embodiment of the invention, there can be attained an apparatus for processing a tape in which the program is processed by the computer, thereby enabling the user to visually recognize, during the tape processing operations, as to whether the apparatus is in the embossing operation or in the tape feed operation.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, a description will now be made about a method of controlling a tape processing apparatus, a tape processing apparatus, and a program relating to an embodiment of the invention. In this invention, the embossing indication which is the indication during embossing operation and the feed indication which is the indication during feed operation are indicated in modes which are different from each other so that the user can recognize whether the apparatus is in the embossing operation or in the feed operation. A description will be made here about an example in which the tape processing apparatus of this invention is applied to a label forming apparatus which forms a Braille-character label having disposed therein in one and the same processing tape both Braille characters recognizable by a visually handicapped person and ink characters recognizable by a person having an ordinary eyesight without a visual handicap.

Figure 1:
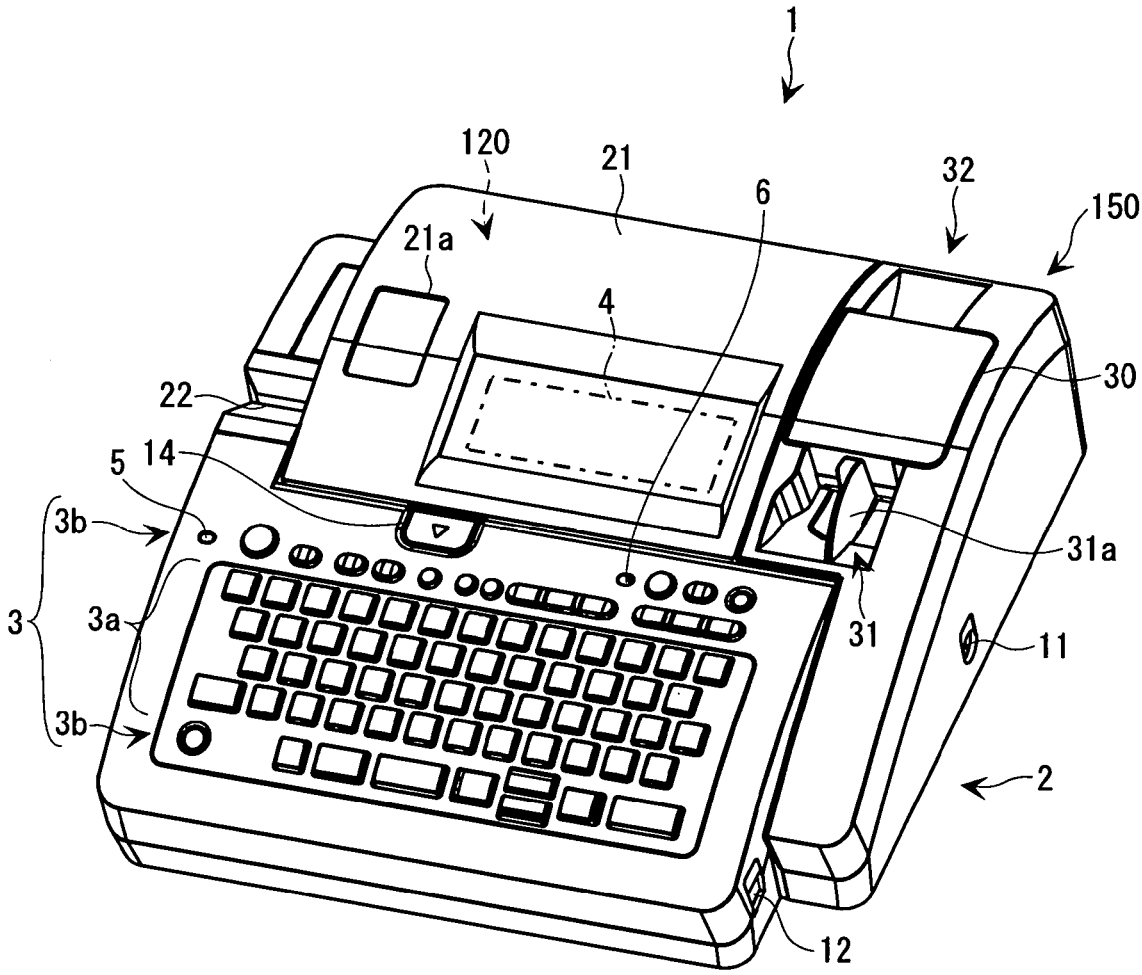
FIG. 1 is an outside perspective view of a label forming apparatus (a tape processing apparatus) with an open-close lid closed according to an embodiment of the invention.
Figure 2:
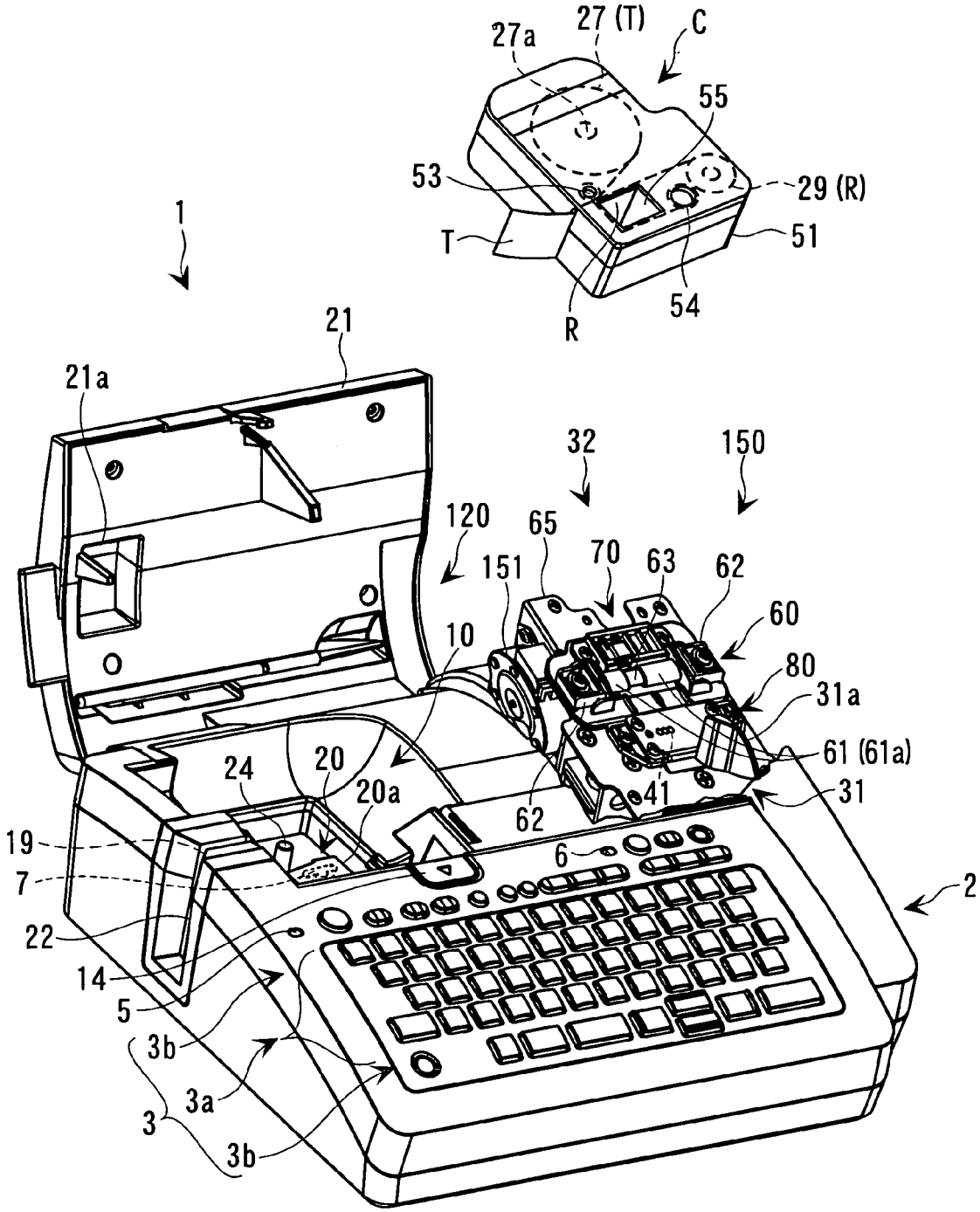
FIG. 2 is an outside perspective view of the label forming apparatus with the lid left open.

FIG. 1 is an external perspective view of a label forming apparatus 1 with its open-close lid being closed. FIG. 2 is an external perspective view of the label forming apparatus 1 with the open-close lid being left open. In FIG. 2 an apparatus casing 2 is partly omitted to facilitate understanding of a Braille-character embossing section 150 which performs embossing of Braille characters. As shown in FIGS. 1 and 2, the label forming apparatus 1 has the apparatus casing 2 to formulate the outline of the apparatus. The apparatus casing 2 has disposed a keyboard 3 in a front upper part thereof and an open-close lid 21 in a rear upper part thereof. Inside the open-close lid 21 is disposed an ink-character printing section 120 which performs printing of ink characters on a tape T to be paid out (or fed) from a tape cartridge C. On the right-hand side of the open-close lid 21 (i.e., the rear right-half portion of the apparatus casing 2), there is disposed a Braille-character embossing section 150 which performs embossing of Braille characters on the processing tape T to be manually fed from the front-half portion thereof.

On a front side of the open-close lid 21, there is formed a display 4 of a rectangular shape. On an inner left side of the open-close lid 21, there is formed in a recessed manner a cartridge mounting section 10 (ink-character printing section 120) for mounting therein the tape cartridge C. The tape cartridge C is detachably mounted on the cartridge mounting section 10 in a state in which, with the depression of a lid-open button 14, the open-close lid 21 is left open. The open-close lid 21 has formed therein a peep hole 21*a* for recognizing the presence (mounting) or absence of the tape cartridge C with the open-close lid 21 being kept closed.

The display 4 is capable of displaying display image data of 192 dots×80 dots on an inside of a rectangular shape of about 12 cm in the lateral direction (X direction) and about 5 cm in the vertical direction (Y direction). The display 4 is used by the user in inputting character information from the keyboard 3 so as to form and edit ink-character data for performing printing of ink characters or Braille-character data for performing embossing of Braille characters. It is also used in indicating (or displaying) various errors and messages (contents of operations and commands) to report them to the user.

On the other hand, on an upper surface of the apparatus casing 2, there are disposed: the keyboard 3 having various input keys; a power lamp 5 to show that the power is switched on; and a Braille-character lamp 6 (indicator or indicating lamp) to show that the apparatus is embossing Braille characters (tape processing operation). The Braille-character lamp 6 is a single-color LED (light-emitting diode) which shows by its flashing that the Braille-character embossing section 150 is in the course of being processed, or that something abnormal has happened to the Braille-character embossing section 150. By varying the period of flashing or by varying the ratio of light-up time (ON time)/shut-off time (OFF time) in one flashing period, the contents of on-going processing (i.e., processing being performed currently) or abnormalities can be reported to the user (see FIGS. 9A to 9C).

The keyboard 3 has disposed therein character key group 3*a* and function key group 3*b* for specifying (or designating) various operation modes, or the like. The character key group 3*a* is used in inputting ink-character data for performing printing of ink characters and in inputting Braille-character data for performing embossing of Braille characters, and is in a full-key arrangement based on Japanese Industrial Standards (JIS) arrangement. It is also possible to cause to perform both the ink-character printing and Braille-character embossing based on the same data, instead of separately inputting the ink-character data and the Braille-character data.

Figure 7A:
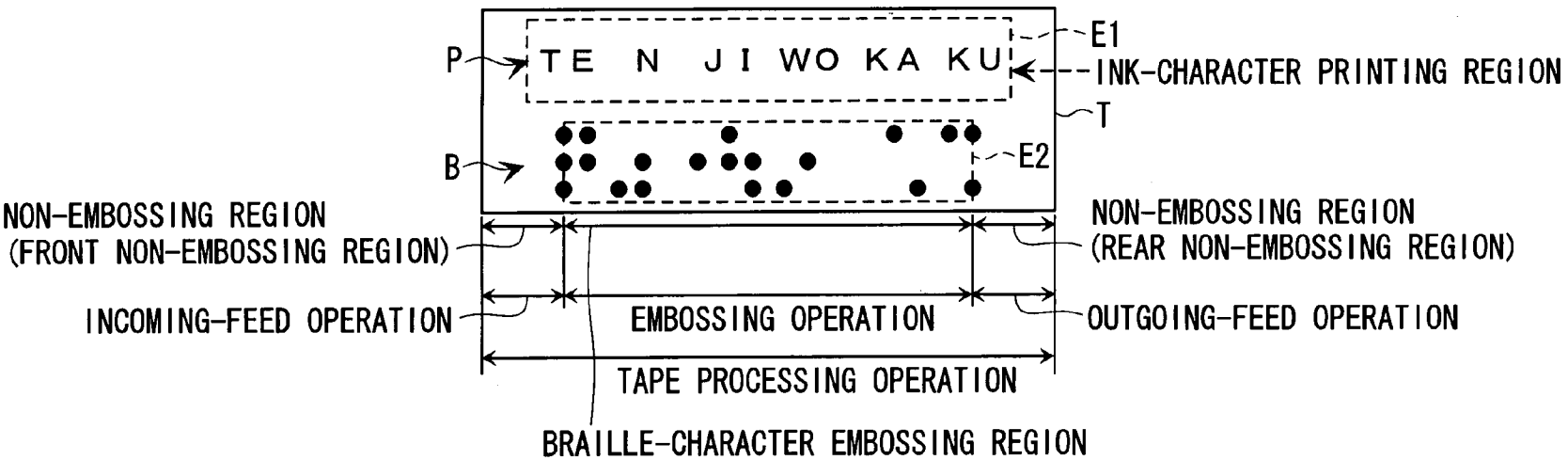
FIGS. 7A and 7B show each of regions on a processing tape and operations corresponding thereto.
Figure 7B:
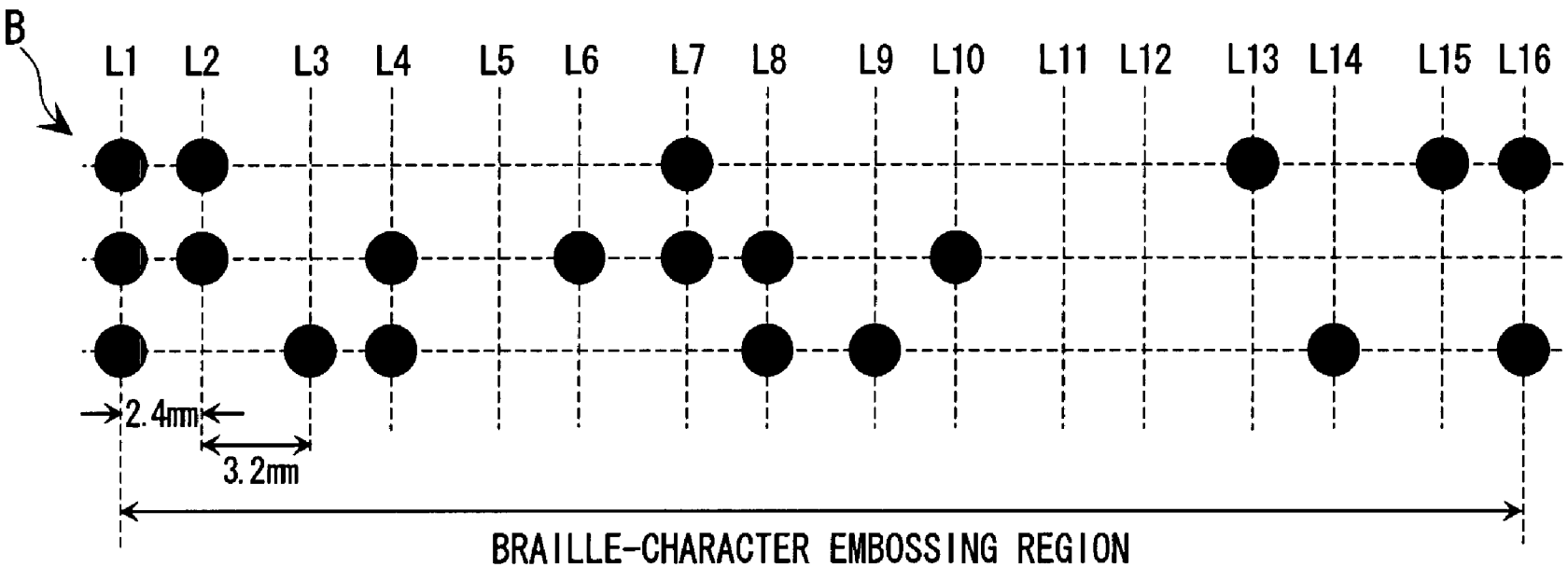

The function key group 3*b* includes: mode selection key for selecting the processing mode; execution key for starting the processing of ink-character printing and/or the processing of Braille-character embossing; feed-start key for commanding to start feeding of the processing tape T in the Braille-character embossing section 150; emboss-start key for causing to manually start the embossing of Braille characters; and arrangement designating key for designating the arrangement of an ink-character printing region E1 for performing therein the printing of ink characters and a Braille-character embossing region E2 for performing therein embossing of Braille characters (see FIGS. 7A and 7B).

The mode-selection key is capable of selecting one of: a first processing mode in which both ink character and Braille character are arranged in parallel with each other; a second processing mode in which only ink characters are printed; and a third processing mode in which only Braille characters are embossed. In case the first processing mode is selected, the processing of Braille-character embossing is performed after the processing of ink-character printing is performed. The reason for adopting the above processing order is to eliminate the problem in that the printed ink characters P may partly be garbled by the embossed projections 202 (see FIG. 3B) formed in embossing operation, in case the Braille-character embossing operation is performed first. In case the second processing mode is selected, the tape processing apparatus is operated as an ordinary tape printing apparatus to perform the processing of ink-character printing. In case the third processing mode is selected, the tape printing apparatus is operated as a Braille-character embossing apparatus to perform processing of Braille-character embossing.

The arrangement designating key, on the other hand, is capable of designating: the widthwise position, in the tape, of the ink-character printing region E1 and the Braille-character embossing region E2 (e.g., the ink-character printing region E1 and the Braille-character embossing region E2 are arranged in upper-and-lower positional relationship, or they are overlapped, or the like); and the longitudinal position, in the tape, of each of the regions E1, E2 (left justification, centering, right justification, or the like). Aside from the above keys, the function key group 3*b* has, like in the ordinary word processor, delete key for deleting the processing, cursor key for moving the cursor, enter key for determining the alternatives in various selection screen or for line feeding (return) at the time of text inputting.

A description will again be made about the construction of the apparatus. In the right central portion of the apparatus casing 2, there is formed a power supply port 11 for supplying electric power therefrom. In a right front half portion of the apparatus, there is formed a connection port 12 (interface) for connection to an outside apparatus (not illustrated) such as a personal computer, or the like. By connecting the outside apparatus to the connection port 12, ink-character printing and Braille-character embossing can be performed based on the character information generated by the outside apparatus. In addition, in a left side portion of the apparatus casing 2, there is formed a printed-tape outlet (discharge opening) 22 which communicates the cartridge mounting section 10 with the outside. A tape cutter 19 of a pair of scissors type for cutting the processing tape T sent out of the ink-character printing section 120 lies close to the printed-tape outlet 22. By thus cutting the processing tape T with the tape cutter 19, there is discharged a processing tape T on which are printed ink characters.

A description will now be made about the construction around the ink-character printing section 120 (cartridge mounting section 10) and the Braille-character embossing section 150. The cartridge mounting section 10 has: a head unit 20 which contains inside a head cover 20*a* a printing head 7 made of a thermal head; a platen drive shaft (not illustrated) which lies opposite to the printing head 7; a winding drive shaft (not shown) which winds up an ink ribbon R which is described hereinafter; and a positioning boss 24 for a tape reel 27 which is described hereinafter. On a lower side of the cartridge mounting section 10, there is housed a print-feed motor 121 which rotates the platen drive shaft and the winding drive shaft (see FIG. 6).

The tape cartridge C is constructed by housing, on the upper central part of the cartridge casing 51, a tape reel 27 around which is wound a certain width of the processing tape T and, on the right lower part thereof, a ribbon reel 29 around which is wound the ink ribbon R. The processing tape T and the ink ribbon R are made in the same width. On the left lower part of the tape reel 27, there is formed a through hole 55 for inserting it into the head cover 20*a* which covers the head unit 20. Corresponding to the portion in which the processing tape T and the ink ribbon R are overlapped with each other, there is disposed a platen roller 53 which is driven for rotation by coming into engagement with the platen drive shaft. On the other hand, a ribbon take-up reel 54 is disposed in close proximity to the ribbon reel 29 so that the ink ribbon R once paid out of the ribbon reel 29 is taken up by the ribbon take-up reel 54 which is disposed in a manner to rotate around the head cover 20*a*.

Once the tape cartridge C is mounted on the cartridge mounting section 10, the through hole 55 is inserted into the head cover 20*a*, the central hole 27*a* of the tape reel 27 is inserted into the positioning boss 24, and the central hole of the ribbon take-up reel 54 is inserted into the take-up drive shaft, respectively. The printing head 7 comes into contact with the platen drive shaft (platen roller) with the processing tape T and the ink ribbon R being sandwiched therebetween, thereby attaining a state in which the printing of ink characters is possible. The processing tape T after having finished printing of the ink characters is sent to the printed-tape outlet 22.

Although not illustrated, the processing tape T is made up of a recording sheet of resin (e.g., polyethylene terephthalate) having an adhesive agent layer attached to the rear surface thereof, and a release (peel-off) sheet of resin (e.g., copolymer of polyethylene/polypropylene) which is attached to the recording sheet by means of the adhesive layer. The printed surface of the recording sheet is subjected to a processing to improve the stay of the ink in thermal transfer. Plural kinds of processing tapes T of different kinds are prepared (e.g., tape widths, tape colors, ink-character colors, tape materials, or the like). A plurality of holes (not shown) are provided on the rear surface of the tape cartridge 51 to indicate the kinds of the tape. Corresponding to the plurality of holes, the cartridge mounting section 10 is provided with a plurality of tape recognition sensors 171 (micro switches) (see FIG. 6) to detect the holes. The kind of the tape can thus be made recognizable by detecting the state of the tape recognition sensors 171.

In the rear right half portion of the apparatus casing 2, there is housed an embossing assembly (Braille-character embossing section 150) which performs the embossing of Braille characters, and an embossing-section cover 30 is attached to an upper surface thereof to cover the embossing assembly. On this side (as seen by the user) of the embossing-section cover 30, there is formed an embossing-tape inlet (inserting port) 31 into which the processed tape T is manually inserted by the user and, on the far-end side of the embossing-section cover 30, there is formed an embossed-tape outlet (discharging port) 32 through which the processing tape T which has been embossed with Braille characters is discharged, respectively in a recessed manner so as to be sloped downward toward a tape travel passage 70. Note that the processing tape T is intentionally referred to as "embossing tape" before being embossed (i.e., a tape to be subjected to embossing operation from now on) and as "embossed tape" after having been subjected to embossing operation (on a case-by-case basis where necessary for clarification). Further, in the neighborhood of the embossing-tape inlet 31, there is provided a manual-insertion guide 31*a* whose width is adjustable in the tape width direction.

The Braille-character embossing section 150 has: an embossing unit 80 which performs embossing of Braille characters by means of three embossing pins (embossing heads) 41 (see FIG. 4B); a tape feed unit 60 for feeding the processing tape T which has been inserted into the embossing-tape inlet 31; and a tape travel passage 70 along (or through) which the processing tape T is transported. These units are assembled into a frame which constitutes the tape travel passage 70, thereby forming the embossing assembly so as to be mounted integrally on the apparatus casing 2. Three embossing pins 41 are selectively driven by the embossing unit 80 toward and away from the processing tape T to be fed, along the tape travel passage 70, by the driving of the tape feed unit 60, whereby Braille characters B are formed.

The tape feed unit 60 is made up of: a feed roller 61; a supporting member 62 which supports the feed roller 61 to the apparatus frame 65; and a reversible emboss-feed motor 151 for rotating the feed roller 61. The feed roller 61 is a grip roller which is made up of a driving roller (not shown) and a driven roller 61*a*. The driven roller 61*a* has formed therein an annular groove 63 (see FIG. 5) to prevent the interference with the position corresponding to the three vertical embossing points 201 (see FIG. 3A).

Figure 3A:
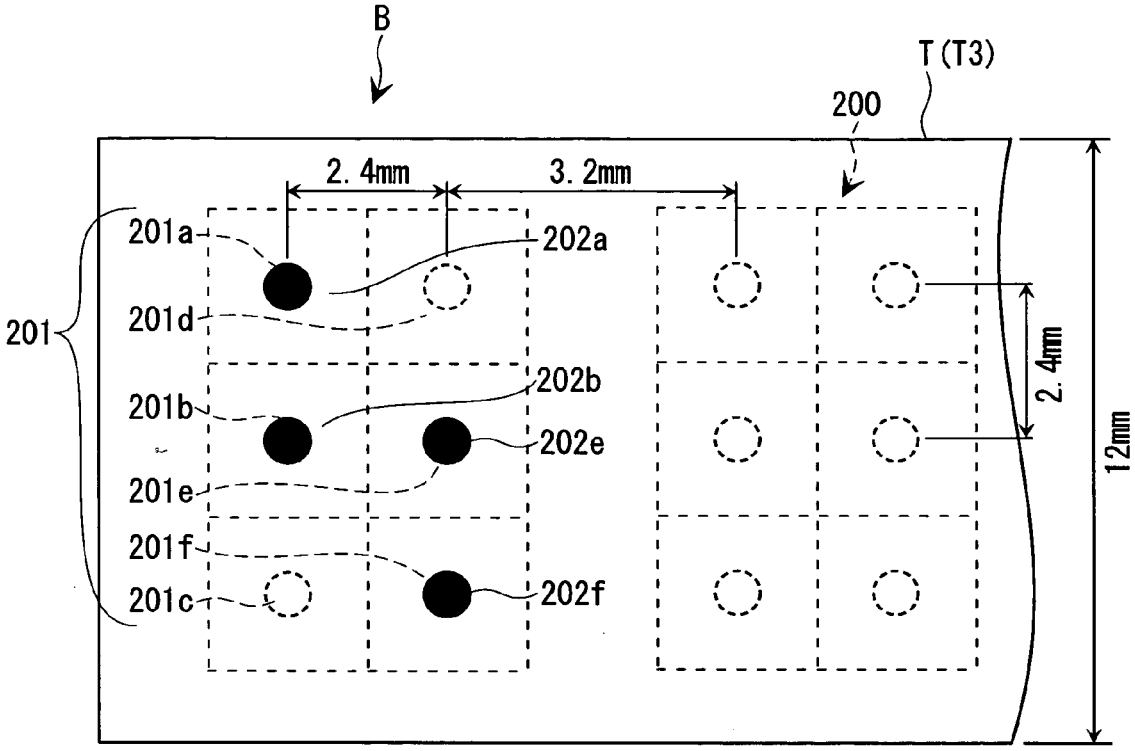
FIG. 3A is a schematic plan view of a six-point Braille character and FIG. 3B is a sectional view of an embossed projection thereof.
Figure 3B:
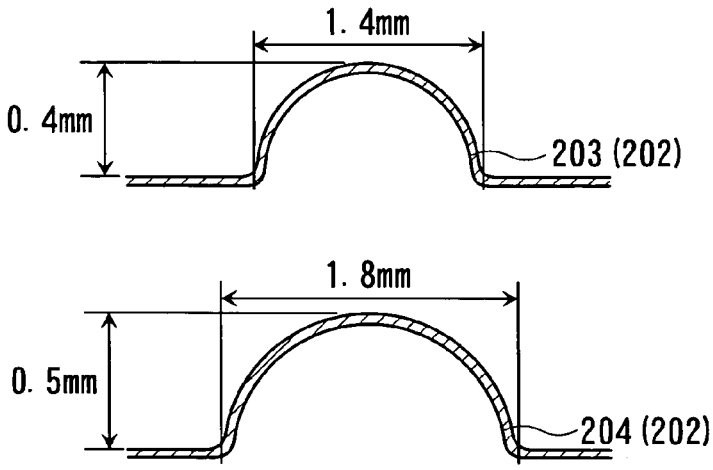

With reference to FIGS. 3A and 3B, a description will now be made about the Braille characters B (six-point Braille characters B) which are formed on the processing tape T (T3, tape width 12 mm). FIG. 3A schematically shows a Braille character (Braille-character data) B representing character information of a Japanese hiragana "SHI." As shown therein, the six-point Braille character B is made up of a total of six points (embossing points), which form one Braille cell 200, six points being arranged in two rows disposed in a side-by-side relationship, each row having three vertically arranged points. Each Braille cell 200 serves to represent a single Braille character or attributes (or properties) such as a voiced sound (e.g., a Japanese voiced sound such as "GA," "GI," "GU," "GE" or "GO" is represented by a combination of two Braille cells, the embossing point corresponding to 202*e* in FIG. 3A of the first-row Braille cell serving to show that the Braille character in question is a voiced sound). As the Braille character B, aside from the six-point Braille character which represents a Japanese hiragana, a numeral, or the like, there is an eight-point Braille character which is made up of a Braille cell having four vertically arranged points in two rows horizontally separate from each other to represents a Chinese character. The invention is applicable also to a label forming apparatus to form the eight-point Braille characters.

The six-point Braille character B has a Braille cell 200 which is divided into six embossing points 201*a* through 201*f* in an arrangement pattern of three vertically arranged points as arranged in two horizontal rows. In the figure, out of the six embossing points, four embossing points 201*a*, 201*b*, 201*e* and 201*f* are selectively embossed to thereby form four embossed projections 202*a*, 202*b*, 202*e* and 202*f* on the processing tape T. The six embossing projections 202 are arranged at a vertical pitch of about 2.4 mm and a horizontal pitch of about 2.4 mm and the pitch between the adjoining Braille cells is about 3.2 mm.

FIG. 3B shows a cross section of the embossed projection 202. As shown therein, the shape of the embossed projection 202 is cylindrical with a rounded corner. Although the cylindrical cross sectional shape with rounded corner is said to be preferable as the embossed projection 202 (because it is better to the sense of touching), another shape such as hemispherical shape, conical shape or quadrangular pyramid shape, or the like will do as well.

The label forming apparatus 1 of this embodiment has two kinds of replaceable units as the embossing unit 80, one being to form small embossed projections 203 and the other being to form large embossed projections 204. The small embossed projection 203 is a cylinder which is about 1.4 mm in diameter and about 0.4 mm in height, and the large embossed projection 204 is a cylinder which is about 1.8 mm in diameter and about 0.5 mm in height. The two small and large embossed projections 203 and 204 are selected depending on the use to which the Braille characters are put. For example, the small embossed projection 203 is for use with the person who is accustomed to the Braille characters B (e.g., the person who is born visually handicapped) and the large embossed projection 204 is for use with the beginner (e.g., the person who has lost his or her eyesight on the way of life).

Figure 4A:
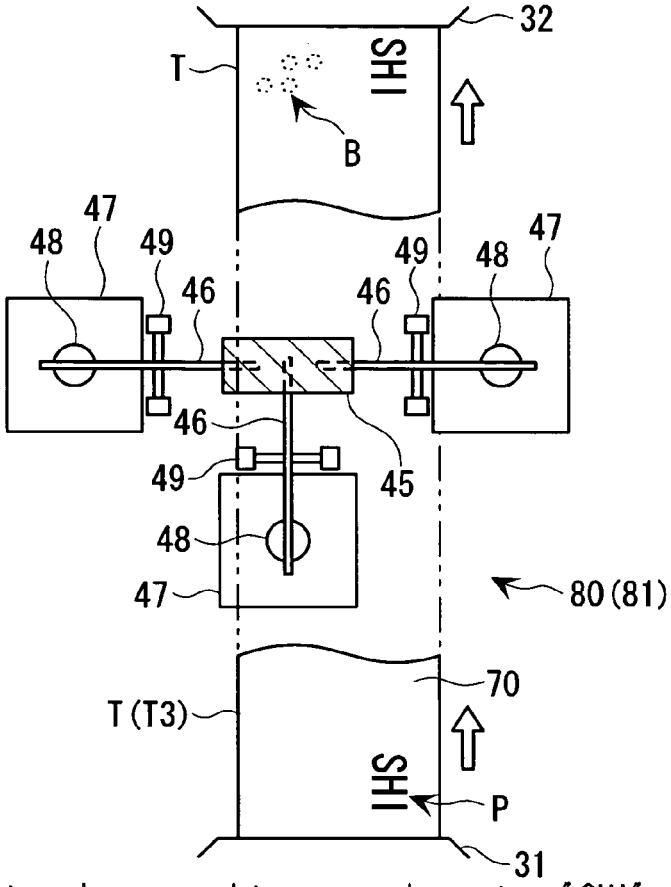
FIG. 4A is a plan view of an embossing unit and FIG. 4B is a sectional view thereof.
Figure 4B:
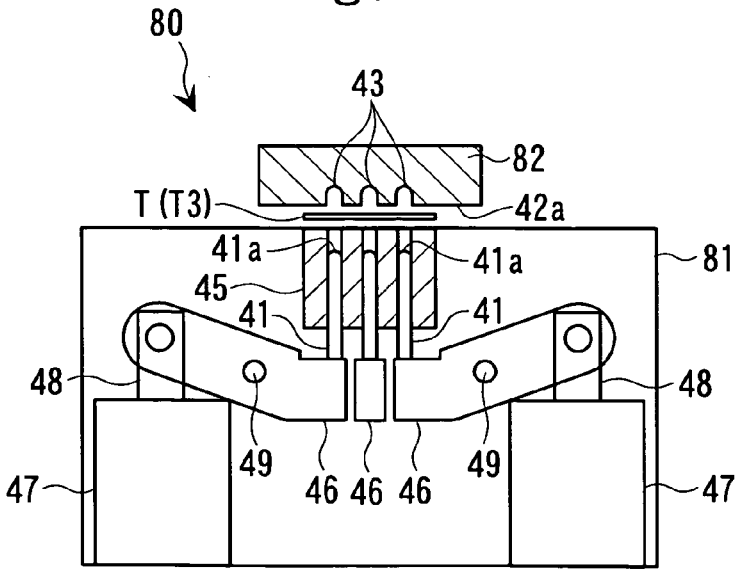

With reference to FIGS. 4A and 4B, a description will now be made about the detailed arrangement of the embossing unit 80. FIG. 4A is a plan view showing the embossing unit 80 as seen from the top in FIG. 1 and FIG. 4B is a sectional view of the embossing unit 80. FIG. 4A shows a state in which the ink-character printing region E1 and the Braille-character embossing region E2 are disposed in a vertical direction (right and left as seen in the figure). The processing tape T with ink characters printed thereon (tape width: 12 mm) is fed from the embossing-tape inlet 31 into the tape travel passage 70 by manual insertion and is fed toward the embossed tape outlet 32.

As shown in both figures, the embossing unit 80 has an embossing member 81 provided with three embossing pins 41, and an emboss-receiving member 82 which receives the upward pushing force (embossing) by these embossing pins 41. On a rear surface of the emboss-receiving member 82, there are assembled therein shock-absorbing springs (not shown).

The embossing member 81 has three embossing pins 41 disposed at a distance of 2.4 mm from each other along the widthwise direction of the tape (left and right direction as seen in the figures). The embossing pins 41 correspond to the three embossing points 201 out of the six embossing points 201, and are held perpendicular to the processing tape T by means of an emboss-pin guide 45 which guides the linear movement of the embossing pins 41 with the solenoids 47 serving as driving sources. The head portion 41*a* of each embossing pin 41 is formed into a cylindrical shape with the front end corner rounded so that the shape of the embossed projection 202 becomes rounded cylinder. In case the shape of the embossed projection 202 is made to be other shape, e.g., hemispherical shape, conical shape, quadrangular pyramid shape, or the like, the head portion 41*a* of the embossing pin 41 shall also be formed into a complementary shape.

To the rear end portion of each embossing pin 41 is connected one end of each arm member 46 in a partly fixed manner. To the opposite end of the embossing pin 41 is pivotally connected the front end portion of a plunger 48 of the solenoid 47 which is described hereinafter. The plunger 48 and the embossing pin 41 are disposed in parallel with each other so that the plunger 48 makes a linear movement perpendicular to the processing tape T. Therefore, when the plunger 48 makes a linear movement by the solenoid 47, the arm member 46 pivots (rotates) with the supporting member 49 serving as a fulcrum and the embossing pin 41 makes a linear movement perpendicular to the processing tape T from the rear side.

The three arm members 46 which are respectively connected to the three embossing pins 41 are constructed such that the two lying in widthwise opposite sides of the processing tape T are elongated to become far away from each other in the widthwise direction of the processing tape T and the remaining one which is located in between is elongated in the longitudinal direction (i.e., in the feeding direction) of the processing tape T. The three solenoids 47 which are respectively connected to the three arm members 46 are disposed to form a triangular shape.

The emboss-receiving member 82 has formed, on a surface 42*a* opposite to the three embossing pins 41, three emboss-receiving recessions 43 corresponding to the three embossing pins 41. These emboss-receiving recessions 43 are formed into a recessed cylindrical shape with a rounded corner to suit the shape of the head portion of the embossing pin 41. The surface 42*a* facing the three embossing pins 41 may alternatively be formed into a flat surface which is made of an elastic member such as synthetic rubber, or the like.

The embossing unit 80 forms embossed projections 202 on the processing tape T by means of the embossing pins 41 and the emboss-receiving member 82. In other words, in response to the inputted Braille-character data (data to represent the embossing/non-embossing of each embossing point 201*a* to 201*f*), the solenoids 47 are energized and the plungers 48 are sucked. The embossing pins 41 then advances perpendicularly to the processing tape T as guided by the emboss-pin guide 45 and abut against the emboss-receiving recessions 43 which lie opposite with the processing tape T therebetween, thereby forming the embossing projections 202 on the processing tape T. When the embossing pins 41 come into abutment with the emboss-receiving recession 43, an embossing sound (or noise) is generated. By means of this embossing sound and the flashing operation of the Braille-character lamp 6 (see FIG. 9B), the user can recognize that the embossing operation is going on.

Figure 5:
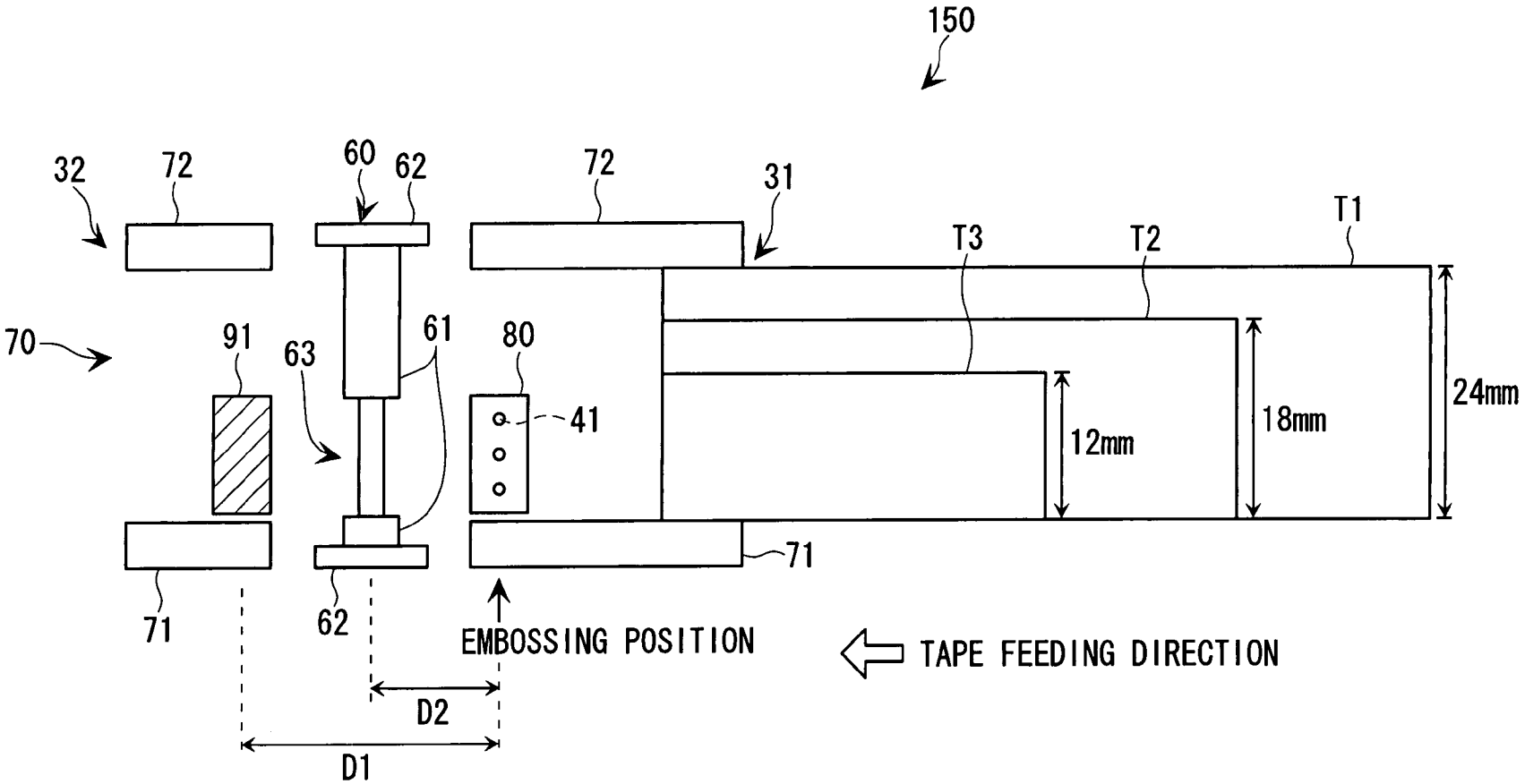
FIG. 5 is a schematic diagram explaining the tape feed operation in the Braille-character embossing section.

Next, with reference to FIG. 5, a description will be made about the feed operation of the processing tape T at the Braille-character embossing section 150. As described above, the Braille-character embossing section 150 has: the embossing unit 80 which forms the embossing projections 202 on the processing tape T with the embossing pins 41; the tape travel passage 70 along which the processing tape T is transported; and the tape feed unit (feeding means) 60 which transports the processing tape T along the tape travel passage 70; as well as guide members 71, 72 which guide the transporting of the processing tape T in the tape travel passage 70; and a transparent type of front-end detection sensor 91 which detects the front end of the processing tape T.

The embossing-tape inlet 31 is arranged to be capable of inserting thereinto a processing tape T1 (tape width: 24 mm), a processing tape T2 (tape width: 18 mm) and a processing tape T3 (tape width: 12 mm) as listed from the larger one to the smaller one. The processing tape T having the largest width is guided by the upper and lower guides 71, 72 and the processing tapes T2, T3 of the other tape widths are guided by the lower guide member 71 alone. For example, in case the processing tape T3 is used, the user manually inserts the processing tape T3 along the lower guide member 71 until the front end reaches the tape-feed unit 60 (feed roller 61) to the point where the processing tape T can be inserted. Then, by depressing the key on the keyboard 3 to thereby start the tape feeding, the feeding of the processing tape T by the tape feed unit 60 can be started. Thereafter, the Braille-character embossing operation (tape processing operation) is started with the detection of the tape front end by the front-end detection sensor 91 serving as a trigger. At this time, in case the length of the front non-embossing region (see FIG. 7A) between the front end of the tape and the position of starting the embossing is set shorter than the length D1 between the embossing unit 80 (embossing pins 41) and the front-end detection sensor 91 (it is however the prerequisite, due to the positional relationship of the feed roller 61, that the non-embossing region is set longer than the length D2 between the embossing unit 80 and the feed roller 61), the feed roller 61 is rotated in the opposite direction to thereby return the processing tape T. When the processing tape T is returned to a suitable position, the embossing and the feeding of the processing tape T in the normal direction are started. The Braille-character embossing operation by the embossing unit 80 may be manually started by depressing the emboss-start key on the keyboard 3 by the user, in place of an arrangement in which the detection of the tape front end by means of the front-end detection sensor 91 is served as the trigger for starting the operation.

A description will now be made about a series of Braille-character embossing operations by using, as an example, a case in which a Braille-character "SHI" (in Japanese "hiragana"; the embossed character relates to hiragana "SHI," not alphabets "S," "H," "I") is embossed (see FIG. 3A). The processing tape T inserted from the embossing-tape inlet 31 travels along the tape travel passage 70 until the embossing points 201*a*, 201*b* and 201*c* on the first row are fed to the position (embossing position) which faces the three embossing pins. Once the processing tape T is fed to this position, the tape feeding is temporarily stopped to thereby perform the Braille-character embossing. The first row of the Braille character "SHI" (in hiragana) will be embossed at the embossing points 201*a* and 201*b*. It means that, out of the three embossing pins 41, the upper embossing pin 41 is driven to thereby form an embossed projection 202*a*. Then, by driving the intermediate embossing pin 41, the embossed projection 202*b* is formed. In this manner, when the embossing of the embossing points 201*a* and 201*b* on the first row has been finished, the tape is fed once again by about 2.4 mm. Similarly, by means of the two embossing pins 41 in the intermediate and the lower positions out of three embossing pins 41, the embossing points 201*e* and 201*f* are embossed, thereby forming two embossed projections 202*e*, 202*f* on the surface of the tape. Once the embossing operation has been finished, the tape is fed to the position in which the embossing row having the next embossing point (real embossing point) requiring the drive of the embossing pins 41 faces the embossing pins 41, thereby performing Braille-character embossing operation. In case there is no more actual embossing points (i.e., the embossing of the last embossing row has been finished), the tape feeding is performed based on the length of a rear non-embossing region which is the rear-side region of the Braille-character embossing region (see FIG. 7A) so that the embossed tape is discharged out of the embossed tape outlet 32.

Figure 6:
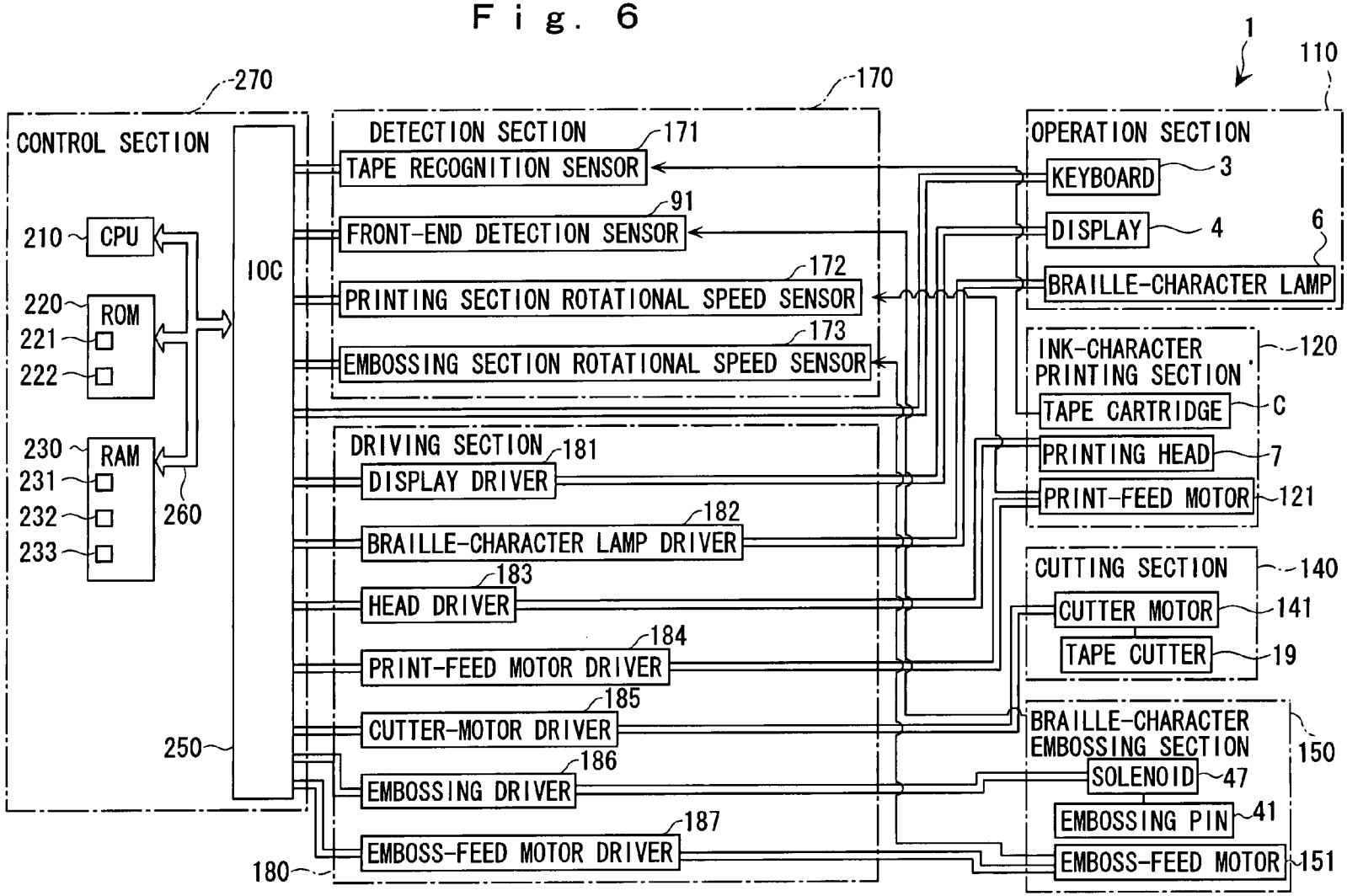
FIG. 6 is a control block diagram of the label forming apparatus.

With reference to FIG. 6, a description will be made about the control construction of the label forming apparatus 1. The label forming apparatus 1 is made up of: an operation section 110 having the keyboard 3, the display 4 and the Braille-character lamp (indicating lamp) 6 so as to control the user interface such as inputting of the character information or displaying of various kinds of information by the user; an ink-character printing section 120 having the tape cartridge C, the printing head 7 and the print-feed motor 121 (stepping motor) so as to print ink characters, based on the ink-character data, on the processing tape T while transporting the processing tape T and the ink ribbon R; a cutting section 140 having the tape cutter 19, and the cutter motor 141 to drive the tape cutter 19 so as to cut the printed processing tape T to a predetermined length; a Braille-character embossing section 150 having the solenoids 47, the embossing pins 41 and the emboss-feed motor (stepping motor) 151 so as to emboss Braille characters, on the processing tape T, based on Braille-character data while feeding the processing tape T; a detection section 170 having a tape recognition sensor 171 for detecting the kind of the processing tape T (tape cartridge C), the front-end detection sensor 91 for detecting the front end of the processing tape T in the Braille-character embossing section 150, a printing section rotational speed sensor 172 for detecting the rotational speed of the print-feed motor 121, and an embossing section rotational speed sensor 173 for detecting the rotational speed of the emboss-feed motor 151, thereby performing various detecting operations; a driving section 180 having a display driver 181, a Braille-character lamp driver 182, a head driver 183, a print-feed motor driver 184, a cutter-motor driver 185, an embossing driver 186 and an emboss-feed motor driver 187, thereby driving each member; and a control section 270 which is connected to various sections so as to control the entire label forming apparatus 1.

The control section 270 has a CPU 210, a ROM 220, a RAM 230 and an input/output control apparatus (hereinafter abbreviated as IOC) 250, which are connected together by an internal bus 260. The ROM 220 has: a control program block 221 which stores therein a control program for controlling various processing such as ink-character print-processing, Braille-character emboss-processing, or the like; and a control data block 222 which stores therein ink-character font data for performing ink-character printing, Braille-character font data for performing Braille-character embossing, as well as control data for controlling the display control of the Braille-character lamp 6 (Braille-character lamp driver 182), or the like.

The RAM 230 has: various work area blocks 231 to be used as flags, or the like; an ink-character printing data block 232 for storing therein ink-character printing data having developed the inputted ink-character data; and Braille-character embossing data block 233 for storing therein Braille-character embossing data which represents embossing/non-embossing of each embossing point (201*a*, 201*b*, 201*c* or 201*d*, 201*e*, 201*f*) of the respective embossing rows. The RAM 230 serves the purpose of a working region for control processing. The RAM 230 is constantly backed up so as to keep the stored data even in case of power failure.

In the IOC 250, there is assembled a logic circuit which supplements the function of the CPU 210 and also handles interface signals with various peripheral circuits, the logic circuit being constituted by a gate array, custom LSI (pulse control LSI), or the like. According to this arrangement, the IOC 250 captures the input data from the keyboard 3 and control data as they are or with due processing into the internal bus 260 and, in a manner interlocked with the CPU 210, outputs the data outputted from the CPU 210 to the internal bus 260 or control signals to the driving section 180 as they are or with due processing.

According to the above arrangement, the CPU 210 inputs various signals and data from each section of the label forming apparatus 1 through the IOC 250 based on the control program in the ROM 220. In addition, by processing the various data inside the RAM 230 based on the various inputted signals and data to thereby output various signals and data to each section inside the label forming apparatus 1, the control of the ink-character print-processing and the Braille-character emboss-processing as well as the indicating control of the indicating lamp (Braille-character lamp) 6 are performed.

When the character information is inputted through the keyboard 3, the CPU 210 generates based thereon ink-character data and Braille-character data and further develops them to a state in which they can be printed and embossed, respectively. They are temporarily stored in the ink-character printing data block 232 and the Braille-character embossing data block 233, respectively. The driving of the solenoids 47 which are the driving source of embossing is controlled as a result of writing, by the CPU 210 into the pulse control LSI, of parameters based on the Braille-character embossing data and by operating the embossing driver 186 by the pulse control LSI. Further, the driving force of the print-feed motor 121 and the emboss-feed motor 151 is adjusted by operating the motor drivers 184, 187 depending on the material of the tape, or the like, to be judged based on the result of detection by the tape recognition sensor 171.

When a command to perform the first processing mode (both ink-character printing and Braille-character embossing) is received from the keyboard 3 for ink-character print-processing, the CPU 210 starts the driving of the print-feed motor 121 to thereby perform the tape feeding, based on the ink-character printing data in the ink-character printing data block 232 (inclusive of front-margin data in case the length of the front margin can be set at the time of inputting character information) and based on the designated arrangement, depending on the result of detection by the printing section rotational speed sensor 172. The CPU 210 then performs ink-character printing by driving the printing head 7. Thereafter, by performing the tape feeding by a predetermined length based on the ink-character printing data (inclusive of rear-margin data in case the length of the rear margin can be set at the time of inputting character information), the CPU 210 operates to cut the processing tape T by the tape cutter 19 and to discharge the processing tape T out of the printed-tape outlet 22.

When the user manually inserts into the embossing-tape inlet 31 the processing tape T that has been cut into an elongated rectangular shape (in the absence of reset operation and power-off operation), the CPU 210 drives the tape feed unit 60 based on the Braille-character data in the Braille-character embossing data block 233 and on the arrangement data stored in an arrangement data block (not shown), thereby feeding the processing tape T by a predetermined length (length of front non-embossing region; see FIG. 7A) based on the result of detection by the embossing section rotational speed sensor 173 (inclusive of front-margin data in case the front-margin length can be set at the time of inputting the character information). The CPU 210 then causes the embossing unit 80 to perform Braille-character embossing. After the embossing has been finished, the emboss-feed motor 151 is driven to thereby perform the tape feeding by a predetermined length (the length of the rear non-embossing region, see FIG. 7A) based on the Braille-character embossing data (inclusive of the rear-margin length data in case the length of the rear-margin can be set at the time of inputting character information). The embossed processing tape T is then discharged out of the embossed-tape outlet 32. When the second processing mode is designated, the CPU 210 performs only the ink-character printing. In case the third processing mode is designated, the CPU 210 causes an empty tape (blank tape) of a predetermined length (length based on the Braille-character embossing data) to be prepared in the ink-character print-processing and then to be discharged. The user then manually inserts the blank tape into the embossing tape inlet 31 to thereby perform the processing of Braille-character embossing. When the processing of Braille-character embossing is performed, the CPU 210 causes the Braille-character lamp driver 182 to generate an ON/OFF signal to make different modes of flashing indication in the Braille-character lamp 6, whereby the user is informed of the fact that the apparatus is in the course of performing each operation.

Figure 8:
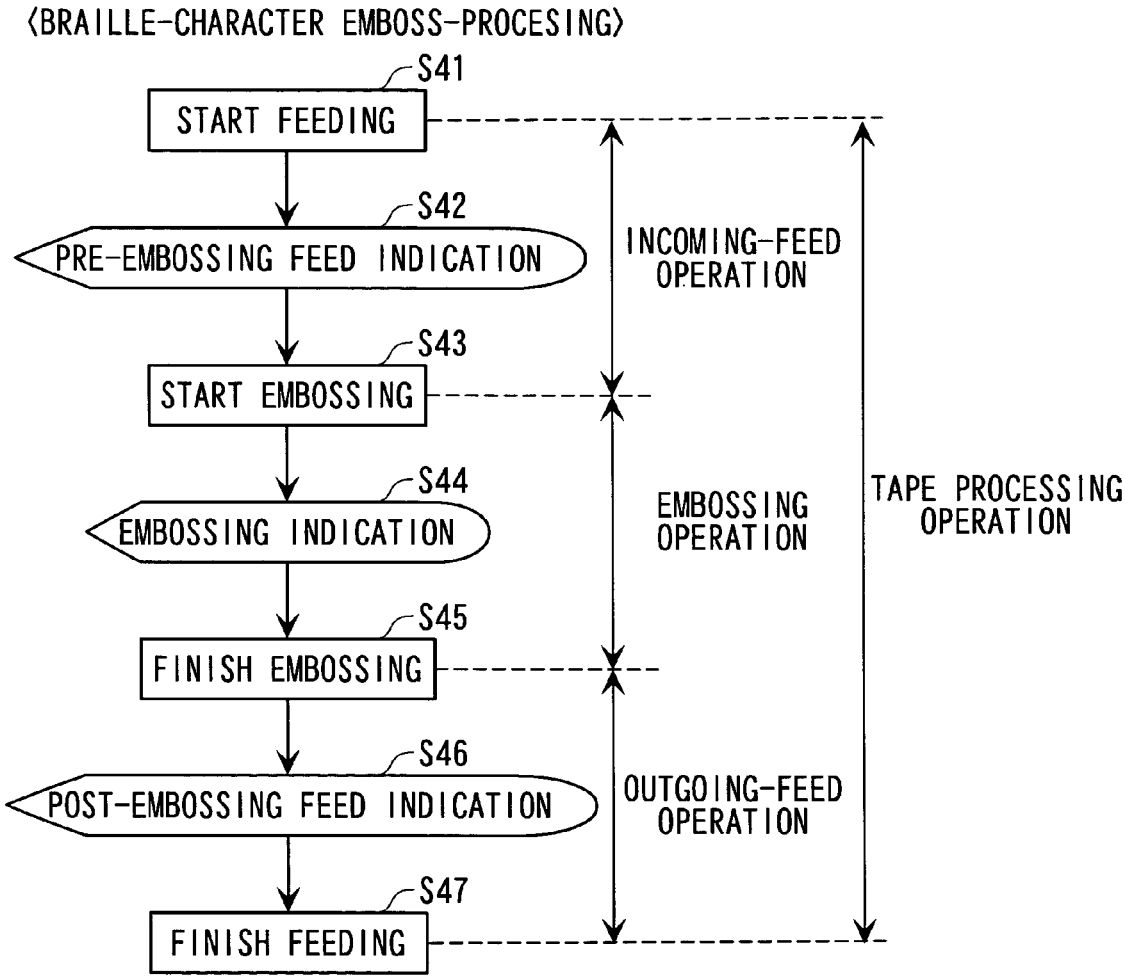
FIG. 8 is a flow chart showing an indication control in connection with the Braille-character emboss-processing.
Figure 9A:
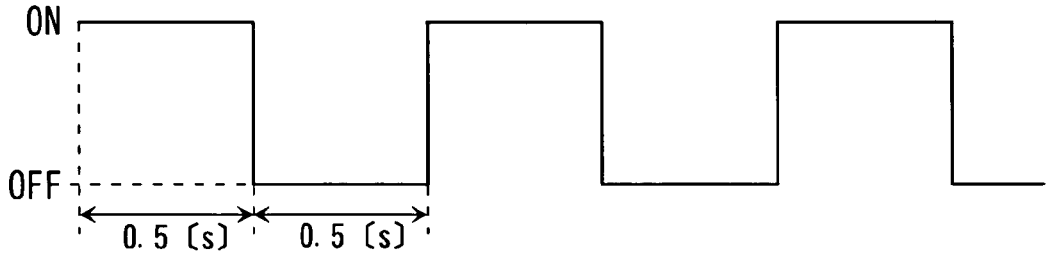
FIGS. 9A to 9C are waveform diagrams showing examples of flashing operation.
Figure 9B:
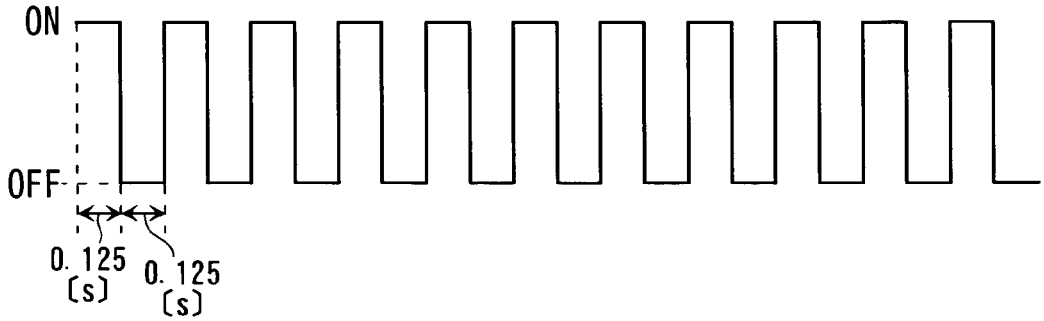
Figure 9C:
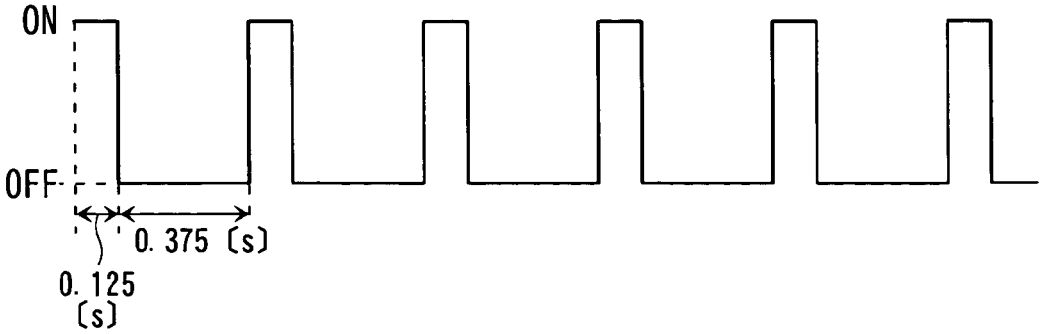

With reference to FIGS. 7A and 7B as well as FIGS. 9A to 9C, a description will now be made about the indication control by the CPU 210 of the Braille-character lamp (indicating lamp) 6 in accordance with the processing of Braille-character embossing. FIGS. 7A and 7B show an example of a formed Braille-character label, FIG. 8 shows a flow chart of indication control relating to the processing of Braille-character embossing, and FIGS. 9A to 9C show examples of flashing operation of the Braille-character lamp 6.

Figure 10A:
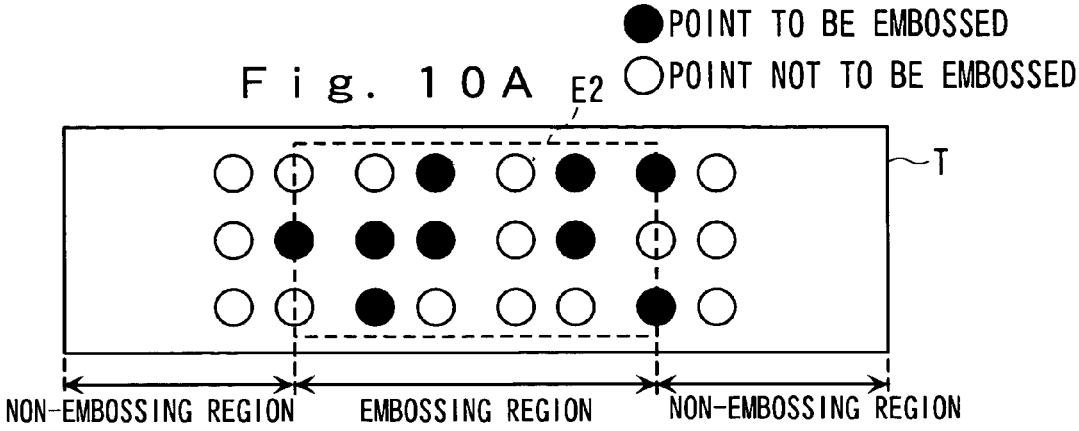
FIGS. 10A to 10D are schematic diagrams showing ranges of Braille-character embossing regions.
Figure 10B:
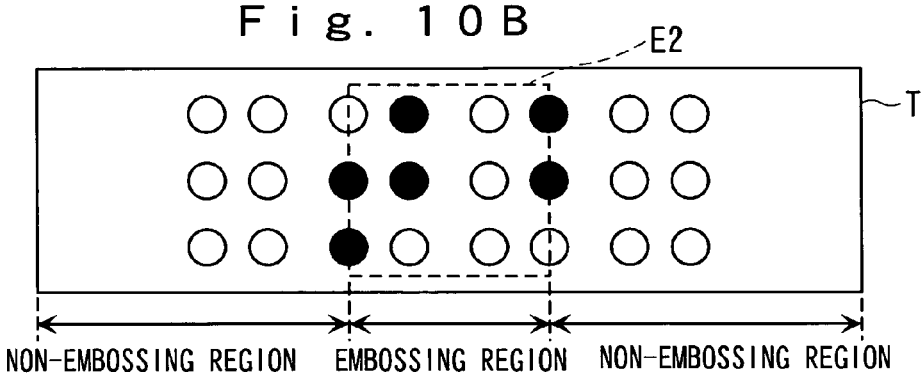

FIG. 7A shows an example of a Braille-character label which is formed when the first processing mode (both ink-character printing and Braille-character embossing) is set, i.e., the ink-character printing region E1 and the Braille-character embossing region E2 are set to "centering" as seen in the longitudinal direction of the processing tape, and the ink-character printing region E1 and the Braille-character embossing region E2 are set to "Braille-character bottom" (i.e., the ink-character printing region E1 is on the upper side and the Braille-character embossing region E2 is on the lower side). To facilitate understanding, the following definition is made in this example: i.e., the region from the front end of the tape to the front embossing row in which the first actual embossing point or points (L1 in FIG. 7B) belong is defined as a front non-embossing region ("front Braille-free region"); the region from the rear embossing row in which the last actual embossing point or points (L16 in FIG. 7B) belong to the rear end of the tape is defined as a rear non-embossing region (rear Braille-free region); and the region between the front embossing row and the last embossing row is defined as a Braille-character embossing region E2. In other words, as shown in FIGS. 10A and 10B, in case the embossing row in which no actual embossing point is present (blank embossing row) is present at the front end and/or the rear end (e.g., in case of a Braille character starting with a voiced sound or in case a space is included at the beginning of Braille-character data), the embossing row in question is disregarded so that the range in which the embossing point(s) is present is defined as the Braille-character embossing region E2. The tape feed operation to feed the front Braille-free region is called as "incoming-feed operation (or "insert-feed operation)," the Braille-character embossing operation in the Braille-character embossing region E2 is called as "embossing operation" and the tape feed operation to feed the rear Braille-free region is called as "outgoing-feed operation (discharge-feed operation)." A series of operations to be performed in the order of "incoming-feed operation," "embossing operation" and "outgoing-feed operation" are called as "tape processing operations."

Namely, the "incoming-feed operation" is an operation which is performed from the point of time in which the user has depressed the feed-start key (start of tape feeding) to the point of time in which the front embossing row (L1) faces or lies in the embossing point (see FIG. 5), i.e., the time to the start of embossing. The "outgoing-feed operation" is an operation from the point of time in which the last embossing row (L16) faces or lies in the embossing point (time of finishing of embossing) to the point of time in which the rear end of the tape passes the feed roller 61 (time until the tape feed operation is finished). The "embossing operation" is an operation of embossing accompanied by the tape feeding (driving of solenoids 47) and refers to the operation of feeding the tape from the point of time in which the front embossing row (L1) faces or lies in the embossing position to the point of time in which the last embossing row (L16) faces or lies in the embossing point.

With reference to the flow chart in FIG. 8, a description will be made about the indication control in performing the Braille-character emboss-processing. First, during the time from the start of feeding of the processing tape (S41) to the start of embossing (S43), i.e., during the incoming-feed operation, "pre-embossing feed indication" is made (S42). The term "pre-embossing feed indication" is for the Braille-character lamp 6 to perform, as shown in FIG. 9A, the flashing operation at a frequency of 1 Hz (flashing period: 1 second), flash-up time (ON time) of 0.5 second, and shut-off time (OFF time) of 0.5 second.

During the time from the start of embossing operation (S43) to the finish of embossing operation (S45), i.e., during the embossing operation, "embossing indication" is made (S44). The term "embossing indication" is for the Braille-character lamp 6 to perform, as shown in FIG. 9B, the flashing operation at a frequency of 4 Hz (flashing period: 0.25 second), flash-up time of 0.125 second, and shut-off time of 0.125 second. During the time from the finish of embossing (S45) to the finish of feeding (S47), i.e., during the outgoing-feed operation, "post-embossing feed indication" is made (S46). The term "post-embossing feed indication" is a flashing operation similar to that in the "pre-embossing feed indication" as shown in FIG. 9A.

As described above, since the label forming apparatus 1 performs the "feed indication" during the incoming-feed operation and the outgoing-feed operation in an indication mode which is different from the "embossing indication" during the embossing operation, the user can recognize what kind of operation (processing) is currently being performed.

In the above example, the "pre-embossing feed indication" and the "post-embossing feed indication" are made in the same manner with each other (a "feed indication"). They may, of course, be made in different modes of indication. It is preferable that the indication is made such that these two indications can be recognized in a manner different from the "embossing indication."

The label forming apparatus 1 is so arranged that it can indicate the abnormal operation (such as abnormal heat generated in solenoids 47, troubles in rotation of the feed roller 61, or the like) aside from the aforementioned indication of "pre-embossing feed indication," "embossing indication," and "post-embossing feed indication." During the abnormal operation, as shown in FIG. 9C, the "abnormality indication" (i.e., an indication of abnormal operation) is made at a frequency of 2 Hz (flashing period: 0.5 second), flash-up time of 0.125 second, and shut-off time of 0.375 second. In this manner, since the "abnormality indication" has a different ratio of flash-up time and the shut-off time in one period of flashing, it is an indication which is quite foreign to the user, i.e., an indication mode which is apparently different from the other indications.

The "abnormality indication" by the Braille-character lamp 6 may be made not only at the time of abnormal operations during Braille-character emboss-processing but also at the time of abnormal operations during ink-character print-processing in the ink-character printing section 120. Further, "abnormality indication" may be made not only during Braille-character emboss-processing and ink-character print-processing but also during the occurrence of all abnormalities in the label forming apparatus 1.

As described hereinabove, according to the invention, the indication of "pre-embossing feed indication" and "post-embossing feed indication" which are the indications during the feed operations is made in such a mode of flashing of the Braille-character lamp 6 as is different from that of the "embossing indication" which is the indication during embossing operation. Therefore, the user can recognize by the indication as to whether the apparatus is undergoing the embossing operation or not. As a result, there is no possibility that the user wrongly tries to pull out the processing tape T in the midst of the embossing operation, this untimely pulling out of the processing tape T causing damages to the embossing unit 80. In addition, even in case where embossing has not been done on the processed tape T, the user can see the cause for the embossing abnormality depending on whether the "embossing indication" was made or not. In other words, if the embossing indication was made, the problem can be seen to lie in the embossing mechanism (embossing unit 80). If, on the other hand, the embossing indication was not made, it means that embossing operation itself was not made, with the result that a judgment can be made that the problem lies in the control mechanism. In case the embossing mechanism is normal, there will occur an embossing noise (or sound) at the time when the embossing pins 41 hit the emboss-receiving recessions 43. By comparing (or referring to) the embossing sound and the indication of the Braille-character lamp 6, the user can judge the cause for the embossing abnormality.

The "abnormality indication" which is the indication when the apparatus is in abnormal operation is made at a different ratio of light-up time and the shut-off time in one flashing period, resulting in an indication which is felt to be quite foreign to the user. As a result, the occurrence of the abnormality can be reported to the user in a more understandable manner.

Figure 10C:
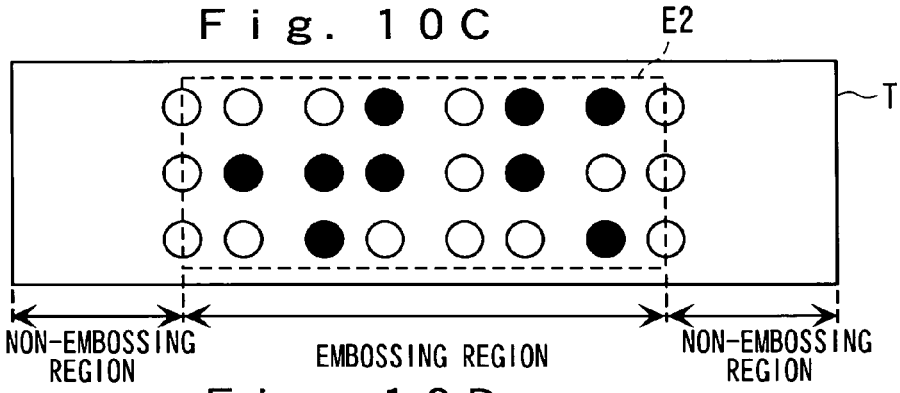

In the above example shown in FIGS. 7A and 7B, the Braille-character embossing region E2 is arranged to be determined by the front embossing row and the rear embossing row both having the actual embossing points (see FIGS. 10A and 10B). However, as shown in FIG. 10C, the Braille-character embossing region E2 may alternatively be set to cover the first embossing row to the last embossing row irrespective of whether there is an actual embossing point or not.

Figure 10D:
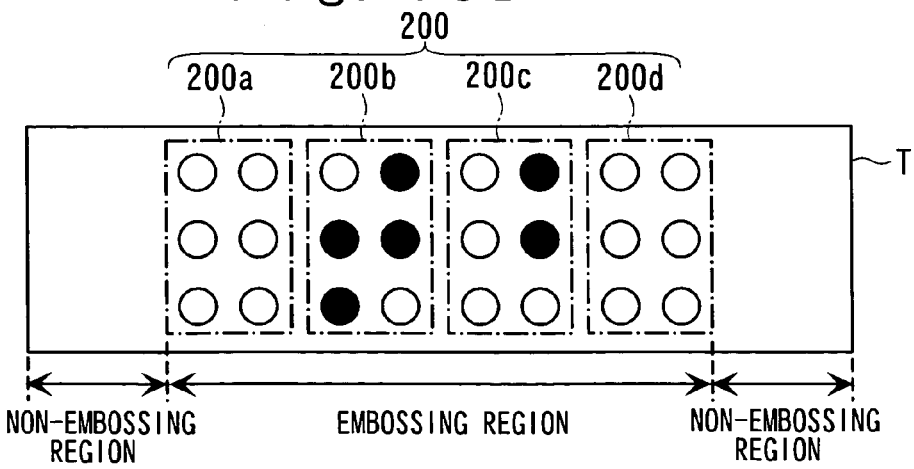

Still furthermore, as shown in FIG. 10D, the Braille-character embossing region E2 may alternatively be set on the basis of each Braille cell 200. Namely, the region from the left-hand end of the first Braille cell 200*a* to the right-hand end of the last Braille cell 200*d* is set as the Braille-character embossing region E2. In case there exists a Braille cell 200 having no actual embossing point therein (i.e., the Braille cell is a blank embossing cell) at the beginning or at the end of the Braille cell group, the Braille-character embossing region E2 may alternatively be set by the Braille cells 200*b* and 200*c* exclusive of the blank Braille cells 200*a* and 200*d*.

Figure 11A:
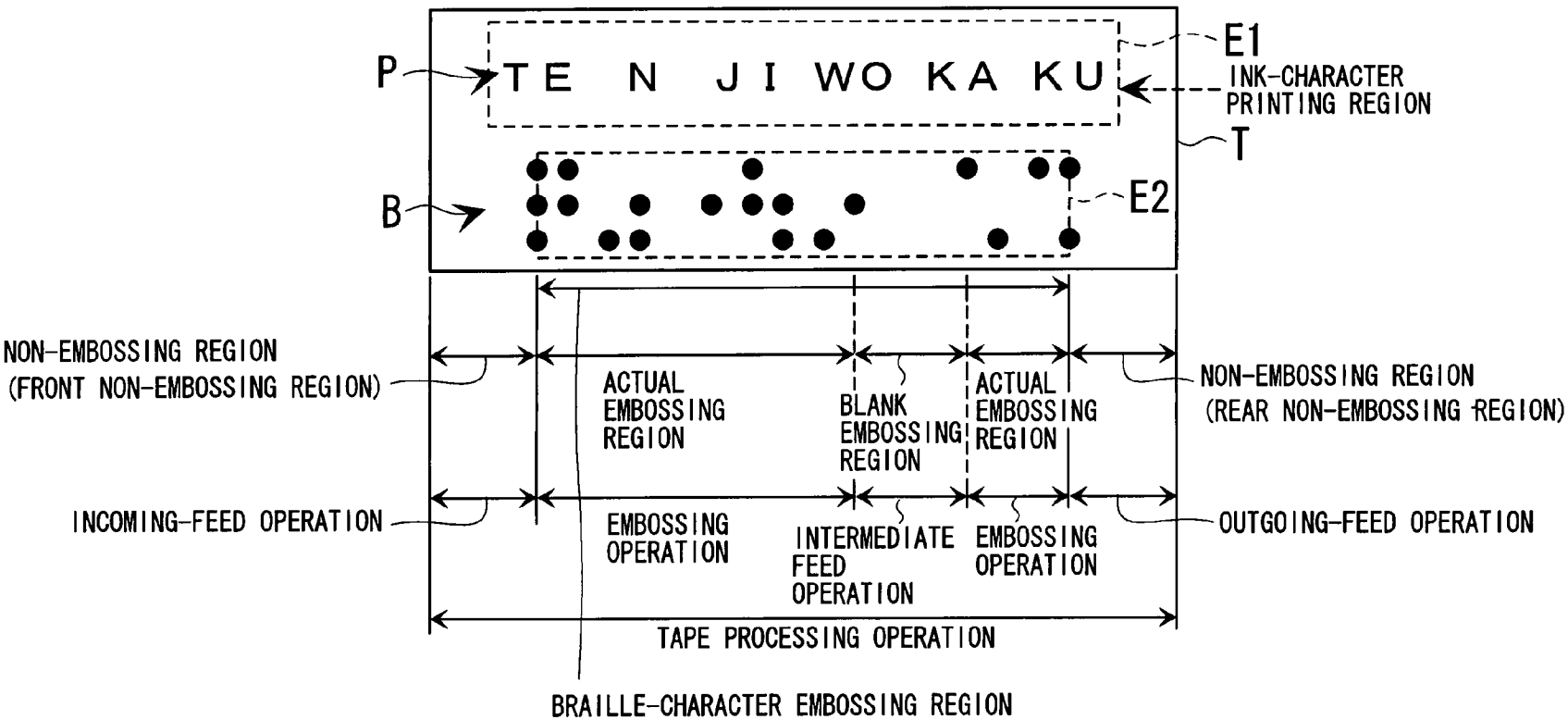
FIGS. 11A and 11B show another example of each of regions of a processing tape and operations corresponding thereto.
Figure 11B:
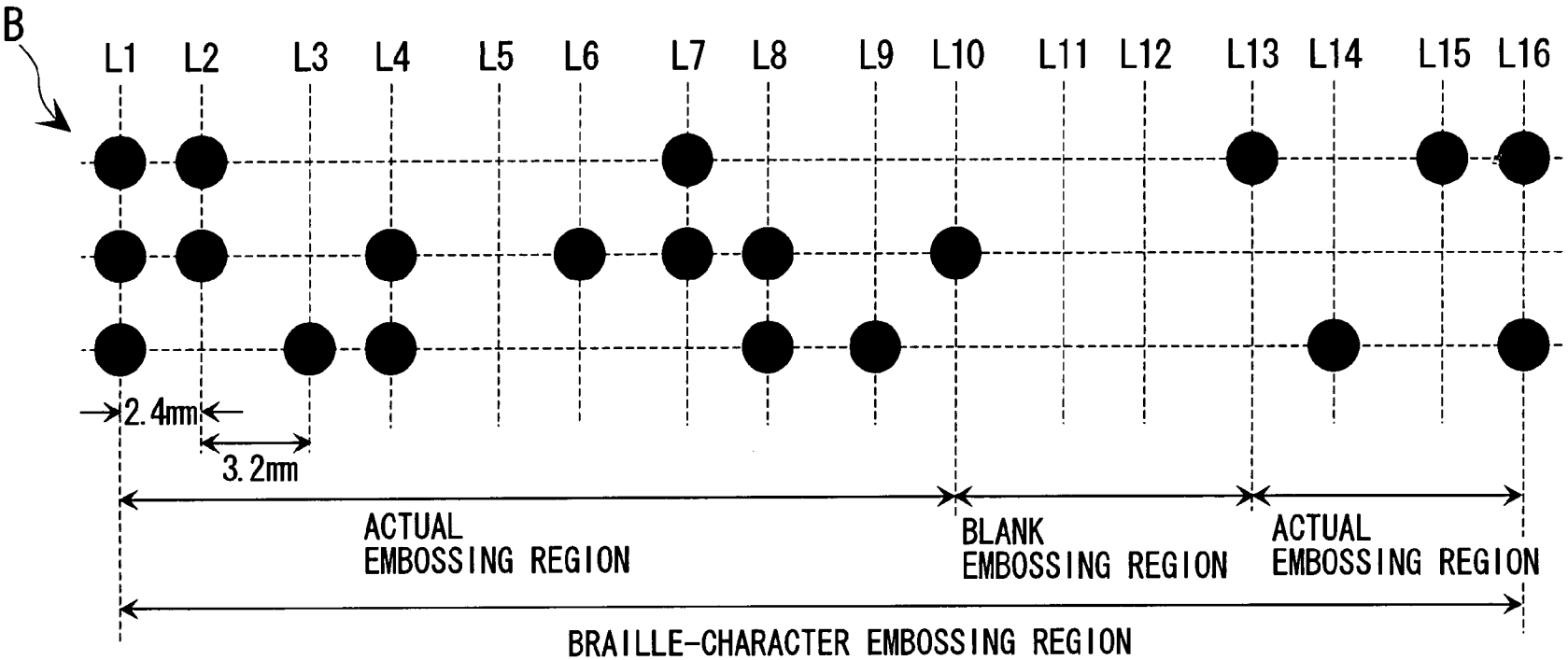

In case Braille-character embossing region E2 has a blank embossing row having no actual embossing point therein, indication of "feed indication" may be made during the feeding through the region exclusive of the blank embossing row. Namely, as shown in FIGS. 11A and 11B, the Braille characters are often represented by using two Braille cells in combination such as in representing voiced sounds, or the like, as earlier explained. In case there exist blank embossing rows (L5, L11 and L12 in the illustrated example) in a predetermined number or more in succession, the indication of "feed operation" may be made while the feeding is made through the region in question. Here, a description will now be made about an example, e.g., in which "feed operation" is indicated when blank embossing rows are present in two rows or more in succession. For convenience' sake, the blank embossing rows which exist in a predetermined number or more in succession as shown in FIG. 11B are referred to as a blank embossing row group (L11 and L12). The region from the row (L10) right before the row (L11) at which the blank embossing row group is started to the row (L13) right after the row (L12), at which the blank embossing row group is ended is referred to as a blank embossing region. The regions other than the blank embossing region within the Braille-character embossing region E2 are referred to as actual embossing regions. In addition, as shown in FIG. 11A, the tape feed operation in the pre-non-embossing region is referred to as "incoming-feed operation," the Braille -character embossing operation in the actual embossing region within the Braille-character embossing region E2 is referred to as "embossing operation," the Braille-character embossing operation in the blank embossing region within the Braille-character embossing region E2 is referred to as "intermediate feed operation," and the tape feed operation in the post-non-embossing region is referred to as "outgoing-feed feed operation."

In other words, in the illustrated example, the operation to feed the tape from the start to the point of time of reaching the front-end row (L1) in the first actual embossing region is "incoming-feed operation." The operation to feed the tape from the point of time when the front embossing row (L1, L13) of the actual embossing region faces the embossing position to the point of time when the last embossing row (L10, L16) of the actual embossing region faces the embossing position is "embossing operation." The operation to feed the tape from the point of time when the front embossing row (L10) of the blank embossing region faces the embossing point to the point of time when the last embossing row (L13) of the blank embossing region faces the embossing point is "intermediate feed operation." The operation to feed the tape from the point of time when the last embossing row (L16) of the last actual embossing region faces the embossing point to the point of time when the tape feeding is finished is "outgoing-feed operation."

While the "incoming-feed operation," "intermediate feed operation" and "outgoing-feed operation" are being performed, the indication of "feed indication" is made (see FIG. 9A) and while the "embossing operation" is being performed, the indication of "embossing indication" is made (see FIG. 9B).

According to the example illustrated in FIGS. 11A and 11B, when there exists a blank embossing region within the Braille-character embossing region E2, the indication of "feed indication" is made while the tape passes through the blank embossing region (during the intermediate feed operation). Therefore, the user can see in detail whether embossing operation is currently being performed or whether only feed operation is being performed.

Figure 12A:
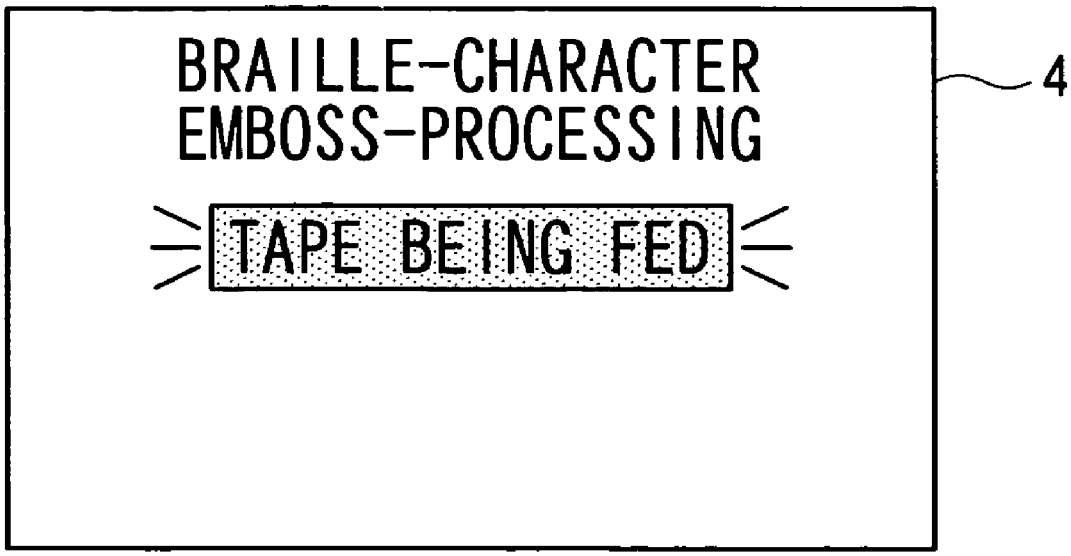
FIGS. 12A to 12C are diagrams showing another example of indication mode.
Figure 12B:
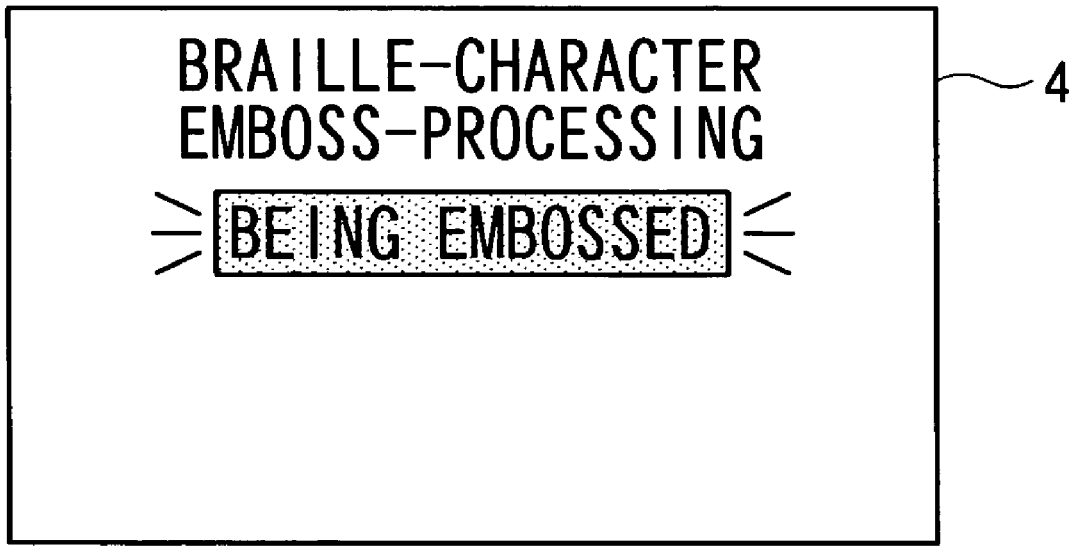

In the above example, an arrangement is made such that the indication of "incoming-feed operation," "embossing operation," and "outgoing-feed operation" is made by the Braille-character lamp 6. Alternatively, as shown in FIGS. 12A to 12B, indication may be made by a display 4. For example, as shown in both figures, an indication of "Braille-character emboss-processing" may be made during the processing of Braille-character embossing (tape processing operations). During the incoming-feed operation and outgoing-feed operation, the indication of "tape being fed" may be made in a flashing manner as shown in FIG. 12A. During the embossing operation, the indication of "being embossed" may be made in a flashing manner as shown in FIG. 12B. In this manner, by indicating on the display 4 that the respective operations are going on, more detailed information can be given to the user in an understandable manner.

Figure 12C:
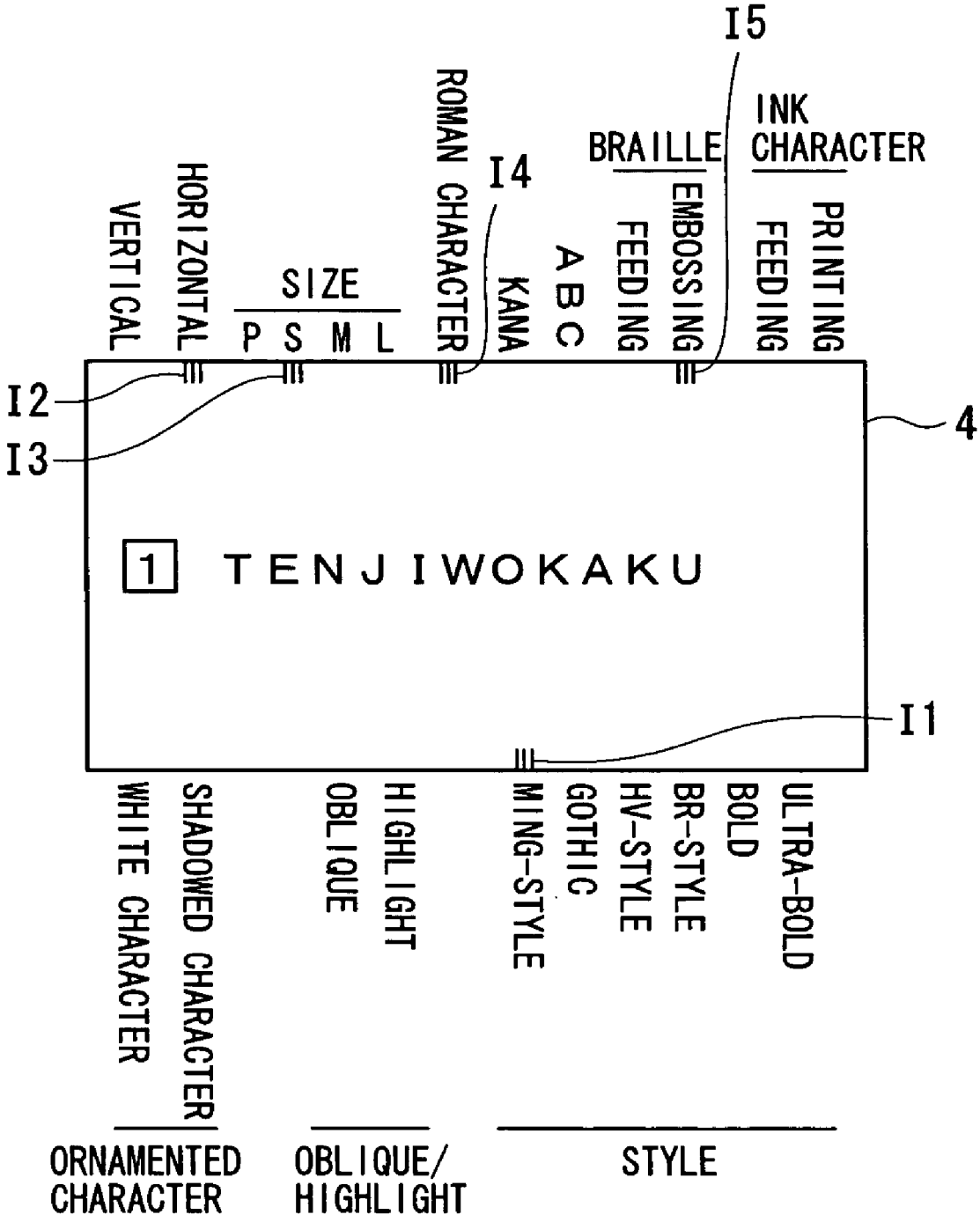

As shown in FIG. 12C, there may be used an indicator I in performing each indication. This indicator I has a function to show the operating conditions and the set contents such that the predetermined marks (I1 through I5) are indicated in accordance with the position of the information marked on the periphery of the display 4. In the illustrated example, the operating conditions can be indicated such as vertical writing/horizontal writing of characters, character size, input mode, ornamented characters, oblique/bolding, contents of setting of typefaces, as well as the operating conditions of the Braille-character embossing and ink-character printing. Here, by the lighting up of indicators I1 to I4, the setting can be seen as Ming-style type, horizontal writing, character size of S in Roman characters. Further, by the flashing of the indicator I5, it can be seen that the apparatus is in embossing operation of tape processing operations. As noted above, with the indicator I utilizing a part of the display 4, each indication can be made. Since this method does not require a mechanism such as the Braille-character lamp 6, or the like, the apparatus can be made lower in cost.

Although not illustrated, the indication may be made by changing the color of the display or by indicating each operation in images. Furthermore, aside from the indication, there may be generated a beep sounds which vary from operation to operation so that the user can audibly recognize each operation.

In case an external equipment such as a personal computer, or the like, is connected to the label forming apparatus 1, the indicating device (display) provided therein may be used in indicating, instead of the display 4 of the label forming apparatus 1. In this example, the control data for displaying (inclusive of indicating data in case of display indication) is transmitted through the connection port 12 to perform indication control. According to this arrangement, the label forming apparatus 1 does not require a mechanism for displaying (Braille-character lamp 6, display 4, or the like), resulting in a simplification of the apparatus construction.

In the above example, the incoming-feed operation is started with the depressing by the user of the starting key serving as a trigger. Alternatively, a sensor may be provided to detect the insertion by the user of the processing tape T so that the automatic feeding of the tape may be started upon detection, by the sensor, of the front end of the processing tape T. According to this arrangement, the user may be saved of the time and trouble of operating the feed-starting key. In addition, the user can conveniently see the timing of leaving his or her finger off from the processing tape T with the help of the "pre-embossing feed indication" (by the flashing of the Braille-character lamp 6, or the like).

In addition, it is also possible to provide each function of the label forming apparatus 1 in the form of a program. The program can also be supplied in the form of being stored in a recording medium (not shown) which may be a CD-ROM; a flash ROM; a memory card such as a compact flash (reg. TM), a smart media, a memory stick, or the like; a compact disk; a photoelectric disk; a DVD; a flexible disk, or the like.

Without being limited to the above example, the arrangement of the label forming apparatus 1 and the processing steps of the invention may be altered without departing from the spirit of the invention. Aside from the label forming apparatus 1, there may be used other apparatuses having an apparatus for performing emboss-operation to carry out the invention.

What is claimed is:

1. A method of controlling a tape processing apparatus which performs, on a tape to be sent from a tape inlet to a tape outlet along a tape travel passage through an embossing section, a series of tape processing operations of incoming-feed operation to feed the tape from the tape inlet to the embossing section, embossing operation in the embossing section, and of outgoing-feed operation to feed the tape from the embossing section to the tape outlet in an order as mentioned above, and which also indicates in an indicator that the apparatus is in the tape processing operations, the method comprising indicating in the indicator a pre-embossing feed indication which indicates the incoming-feed operation and a post-embossing feed indication which indicates the outgoing-feed operation in an indicating mode which is different from that of an embossing indication which indicates that the apparatus is in the embossing operation;

wherein the indicator is an indicating lamp and wherein the embossing indication, the pre-embossing feed indication and the post-embossing feed indication are made by one of lighting up and flashing of the indicating lamp; and wherein the embossing indication, the pre-embossing feed indication and the post-embossing feed indication are made by flashing of the indicating lamp, and wherein flashing periods of the pre-embossing feed indication and the post-embossing feed indication are made longer than a flashing period of the embossing indication.

2. The method according to claim 1, wherein the indicating lamp also indicates an abnormal operation of the apparatus, and wherein the pre-embossing feed operation and the post-embossing feed operation are made in a mode which is different from that of indicating the abnormal operation.

3. The method according to claim 2, wherein the embossing indication, the pre-embossing operation and the post-embossing operation are made in the same ratio of light-up time and shut-off time in one flashing period, and wherein the indication of the abnormal operation is made in a different ratio of light-up time and shut-off time in one flashing period.

4. An apparatus for processing a tape, comprising:

emboss-processing means for performing, on a tape to be sent from a tape inlet to a tape outlet along a tape travel passage through an embossing section, a series of tape processing operations of incoming-feed operation to feed the tape from the tape inlet to the embossing section, embossing operation in the embossing section, and outgoing-feed operation to feed the tape from the embossing section to the tape outlet in the order mentioned;

an indicator to indicate that the apparatus is in the tape processing operations; and indication control means for controlling the indicator such that a pre-embossing feed indication to indicate the incoming-feed operation and a post-embossing feed indication to indicate the outgoing-feed operation are made in an indicating mode which is different from an embossing indication to indicate that the apparatus is in the embossing operating;

wherein the indicator is an indicating lamp and wherein the indication control means indicates the embossing indication, the pre-embossing feed indication and the post-embossing feed indication by one of lighting up and flashing of the indicating lamp; and wherein the indication control means indicates the embossing indication, the pre-embossing feed indication and the post-embossing feed indication by flashing of the indicating lamp, and wherein flashing periods of the pre-embossing feed indication and the post-embossing feed indication are longer than a flashing period of the embossing indication.

5. The apparatus according to claim 4, wherein the indication control means indicates an abnormal operation of the apparatus by flashing of the indicating lamp, and wherein the pre-embossing feed operation and the post-embossing feed operation are indicated in a mode which is different from that of indicating the abnormal operation.

6. The apparatus according to claim 5, wherein the indication of the embossing operation, the indication of the pre-embossing feed operation and the indication of the post-embossing feed operation have the same ratio of light-up time and shut-off time in one flashing period, and wherein the indication of the abnormal operation has a different ratio of light-up time and shut-off time in one flashing period.

7. The apparatus according to claim 4, wherein the emboss-processing means further comprises:

tape feeding means for feeding the processing tape from the tape inlet to the tape outlet through a tape travel passage; and Braille-character embossing means which embosses Braille-characters on the processing tape and which is disposed in the embossing section.

8. The apparatus according to claim 4, further comprising printing means for printing ink characters on the processing tape.

* * * * *